US012017846B2

(12) United States Patent
Aufiero et al.

(10) Patent No.: US 12,017,846 B2
(45) Date of Patent: Jun. 25, 2024

(54) FLEXIBLE FLOATING RESERVOIR FOR STORING AND TRANSPORTING LIQUIDS HEAVIER THAN THE ENVIRONMENTAL LIQUID IN WHICH THE RESERVOIR IS IMMERSIBLE

(71) Applicant: MILANO MULTIPHYSICS S.R.L.S., Milan (IT)

(72) Inventors: Manuele Aufiero, Milan (IT); Carlo Fiorina, Milan (IT); Francesco Di Lecce, Milan (IT)

(73) Assignee: Sizable Energy S.R.L., Milan (IT)

( * ) Notice: Subject to any disclaimer, the term of this patent is extended or adjusted under 35 U.S.C. 154(b) by 18 days.

(21) Appl. No.: 18/002,209

(22) PCT Filed: Aug. 13, 2021

(86) PCT No.: PCT/EP2021/072608

§ 371 (c)(1),
(2) Date: Dec. 16, 2022

(87) PCT Pub. No.: WO2021/255299

PCT Pub. Date: Dec. 23, 2021

(65) Prior Publication Data

US 2023/0227251 A1 Jul. 20, 2023

(30) Foreign Application Priority Data

Jun. 17, 2020 (IT) ..... 102020000014422

(51) Int. Cl.

| | |
|---|---|
| ***B65D 88/78*** | (2006.01) |
| ***B63B 25/14*** | (2006.01) |
| ***B63B 35/44*** | (2006.01) |

(52) U.S. Cl.
CPC ..... *B65D 88/78* (2013.01); *B63B 25/14* (2013.01); *B63B 35/44* (2013.01); *B63B 2035/4433* (2013.01)

(58) Field of Classification Search
CPC ..... B63B 35/44
See application file for complete search history.

(56) References Cited

U.S. PATENT DOCUMENTS

| | | | |
|---|---|---|---|
| 3,429,128 | A | 2/1969 | Stafford et al. |
| 3,517,513 | A | 6/1970 | Renshaw et al. |
| 4,944,872 | A | 7/1990 | Kantor |
| 5,010,837 | A | 4/1991 | Hirose |
| 5,413,065 | A | 5/1995 | Spragg et al. |
| 5,921,421 | A | 7/1999 | Fuquan |
| 6,101,964 | A | 8/2000 | Lesesne |
| 7,500,442 | B1 | 3/2009 | Schanz |
| 8,403,718 | B2 | 3/2013 | Szydlowski et al. |
| 2004/0144294 | A1* | 7/2004 | Yaffe ..... B63B 27/24 114/74 T |

OTHER PUBLICATIONS

International Search Report for International Patent Application No. PCT/EP2021/072608, dated Oct. 8, 2021.

* cited by examiner

*Primary Examiner* — Sean Gugger
(74) *Attorney, Agent, or Firm* — Armstrong Teasdale LLP

(57) ABSTRACT

A flexible floating reservoir for storing liquids denser than the environmental body of water, such as sea salt brine, is provided. The flexible floating reservoir is adaptable to environmental body waves, such as sea waves. A method for operating the flexible floating reservoir and an underwater energy storage system that uses the flexible floating reservoir are also provided.

27 Claims, 14 Drawing Sheets

FLEXIBLE FLOATING RESERVOIR FOR STORING AND TRANSPORTING LIQUIDS HEAVIER THAN THE ENVIRONMENTAL LIQUID IN WHICH THE RESERVOIR IS IMMERSIBLE

CROSS-REFERENCE TO RELATED APPLICATIONS

This application is a National Phase filing of PCT International Application No. PCT/EP2021/072608, having an International Filing Date of Aug. 13, 2021, claiming priority to Italian Patent Application No. 102020000014422, having a filing date of Jun. 17, 2020, each of which is hereby incorporated by reference in its entirety.

BACKGROUND OF THE INVENTION

Field of the Invention

The invention is related to storage and transportation systems for liquids on a body of water (seas, lakes, etc.). More specifically, the invention relates to storage of liquids denser than the environmental body of water and, further, it relates to flexible floating systems in which the liquids are stored or transported.

Related Art

Storage of liquids traditionally relates in the art to rigid floating or underwater vessels. For example, regarding the latter, U.S. Pat. No. 3,429,128 discloses an underwater offshore liquid storage tank, which has a rigid shell and can be floated to a site and submerged.

Widely used structures to transport or contain liquids are rigid metallic vessels mainly designed to withstand two types of stresses: deformations and bending stresses caused by wave motion, specifically by waves with wavelengths of the order of the horizontal dimensions of the structure; the pressure difference between the enclosure where the liquid is placed and the external environment. Beside standard crude oil carriers, an example of rigid vessels is disclosed in U.S. Pat. No. 5,921,421 and consists of two rigid shells, combined with flexible inner bags (so-called "bladders") to store different liquids.

The high cost associated with rigid vessels has led to the development of floating flexible tanks, barges, bags and bladders. These solutions are able to adapt to waves without generating large bending stresses and minimizing pressure differences on the walls. Such floating reservoirs have been designed to transport and/or store liquids less dense than water, such as oil or freshwater in seawater. Examples of floating flexible barges, specifically designed to store and transport liquids lighter than the environmental liquid in which they are immersed, are described hereafter:

U.S. Pat. No. 5,413,065, which discloses a flexible fabric barge apparatus for transporting or storing light liquids (e.g. freshwater or oil).

US 2004/0144294 A1, which discloses an apparatus for sea transport of freshwater that includes flexible collapsible enclosures to allow seawater to fill them causing the freshwater to be expelled against the force of gravity. In particular, US 2004/0144294 A1 discloses a floating flexible tube-like enclosure for the transport of freshwater (or any liquid less dense than seawater) on seawater. The freshwater enclosure contains a plurality of collapsible seawater enclosures, which communicate with the environmental seawater through valves placed on the bottom surface of the freshwater enclosure. In case of full apparatus, the seawater enclosures are empty and in a collapsed state. When the freshwater egresses the main enclosure, environmental seawater enters the enclosures from the environmental body of water. In case of discharged apparatus, the seawater enclosures fill completely the main enclosure volume. Positive buoyancy is ensured in every stage of the apparatus charge. Between each pair of subsequent enclosures there is a series of vertically-extending straps connecting a floating element on the top to a spreader tube on the bottom.

Other pliable structures provide inner separate compartments and bags to store and transport different types of liquids and solids. Examples of patents are reported below:

U.S. Pat. No. 8,403,718B2, which discloses a portable towed elongated vessel suitable for containing and transporting freshwater, wherein buoyancy is controlled via inflatable and water fillable end portions of the vessel. By controlling buoyancy this way, other liquids may also be transported by the vessel.

U.S. Pat. No. 7,500,442B1, which discloses a lightweight towed submerged water transporter and storage system for liquids and solids, which employs a towable hull with optional air and liquid storage bladders used for buoyancy and to allow the simultaneous transport and storage of different solids and liquids. The transporter buoyancy is claimed to be regulated by air inflation.

Therefore, both above-cited last two inventions allow storage and transportation of material denser than the environmental body of water, adopting one internal section or bag filled with a light fluid (e.g. air) to ensure a net global positive buoyancy of the flexible barge.

A further example of offshore storage is disclosed in U.S. Pat. No. 5,010,837. It consists of a flexible film material, sustained by buoys, that accommodates fresh water in a seawater body.

U.S. Pat. No. 4,944,872 A1 discloses a flexible walled conduits and flexible walled enclosures which are adapted to contain fluids at pressures in substantial equilibrium with the pressure of a body of water in which the conduit or enclosure is positioned. Apparatus is shown for segregating solid debris by means of buoyancy characteristics and for removing both heavy and light solids into enclosures from which they can be further processed, recovered or eliminated. Large, flexible walled enclosures are disclosed which are adapted to be used at sea for processing sewage.

U.S. Pat. No. 3,517,513 A1 discloses a floating cistern in the form of an upwardly open (or partially open) water reservoir of impermeable sheet material partly submerged in a body of non-potable water, this reservoir being so anchored or moored as to rise and fall with tides and/or with changing volume of collected rain water. The moorings may include stationary piers or posts driven into the ground around or below the body of water surrounding the reservoir or, in the case of a seagoing cistern, may be constituted by a floating frame. In either case the reservoir can be flexible to accommodate increased volumes of collected water.

U.S. Pat. No. 6,101,964 A1 discloses a floatable fuel tank that is capable of serving as a barge or lifeboat/dingy. The tank comprises a plurality of bladders with each having a fuel chamber and air chamber running longitudinally from stern to a forward bladder. In emergency situations, tank is capable of use as a lifeboat by detaching towing lines, air lines and fuel lines and pumping fuel out of fuel chambers with air so that persons may reside on top of tank. Under normal conditions in this configuration, it could be used as a dingy for normal transportation to and from a boat at anchor.

All the apparatus and systems described above are either constituted by rigid structures, or by flexible structures that are configured to mainly contain liquids less dense than the environmental liquid or different substances with an average density lower than the environmental liquid (seawater), to ensure buoyancy. When transportation of materials denser than the environmental liquid is suggested, the apparatuses always use inner inflatable elements and/or external buoys to regulate flotation and/or buoyancy.

The need of buoys can be huge for stored liquids that are significantly heavier than seawater (such as saturated brine). Moreover, structures to transfer tension from the floatation elements to the reservoir are also expensive. Inner inflatable elements use air, which is per se not expensive but need to be controlled during the operation by actively regulating its pressure, and during the lifespan of the enclosure by guaranteeing sealing, both actions being complex and expensive.

Buoys and inner inflatable elements could be removed from the above prior art devices and these used to store and transport materials which are heavier than the environmental liquid. However, this would have two main negative consequences: firstly, the enclosure would sink indefinitely if the environmental fluid were allowed to surround it; secondly, even solving in some way the first problem in the static situation, such heavier-than-environmental-fluid materials would be subject to the so-called Rayleigh-Taylor instability which would expose the system to a catastrophic dynamic situation.

Indeed, the Rayleigh-Taylor instability concerns the fact that the equilibrium of denser liquid over a lighter one is unstable to any perturbations or disturbances at the interface: if a parcel of heavier fluid is displaced downward with an equal volume of lighter fluid displaced upwards, the potential energy of the configuration is lower than the initial state. Thus the disturbance will grow and lead to a further release of potential energy, as the denser material moves down under the (effective) gravitational field, and the less dense material is further displaced upwards. This will lead eventually to a repositioning of the enclosure and to the inevitable situation where the enclosure is again surrounded by the environmental liquid and sinks indefinitely.

In addition, all the apparatus and systems in the prior art do not address the problem of the lateral stability of the reservoir that arises when storing liquids heavier than the environmental liquid and that originates from the higher hydrostatic pressure of the environmental liquid compared to the stored liquid, at the sides of the reservoir, when the two liquids have the same hydrostatic pressure at the bottom of the reservoir.

Object and Subject-Matter of the Invention

The object of the present invention is a flexible buoyant reservoir for storing and transporting liquids that solves the problems and overcomes the drawbacks of the prior art. The flexible floating reservoir is suited for liquids that are heavier than the environmental liquid in which the reservoir is immersed, without having to rely on separate floating elements (e.g. buoys), without employing enclosure's elements filled with substances lighter than the environmental fluid (e.g., air), preventing the consequences of the instabilities that originate when a heavier liquid is placed on top of a lighter liquid, and preventing the lateral collapse of the reservoir due to the hydrostatic pressure of the environmental liquid.

A subject-matter of the invention is a flexible buoyant reservoir according to the enclosed apparatus claims. Further subject-matter of the invention is a method for storing energy by using the flexible buoyant reservoir, according to the enclosed method claim.

DETAILED DESCRIPTION OF THE INVENTION

List of Figures

The invention will now be described for illustrative but not limitative purposes, with particular reference to the drawings of the attached figures, wherein.

Figure 3:
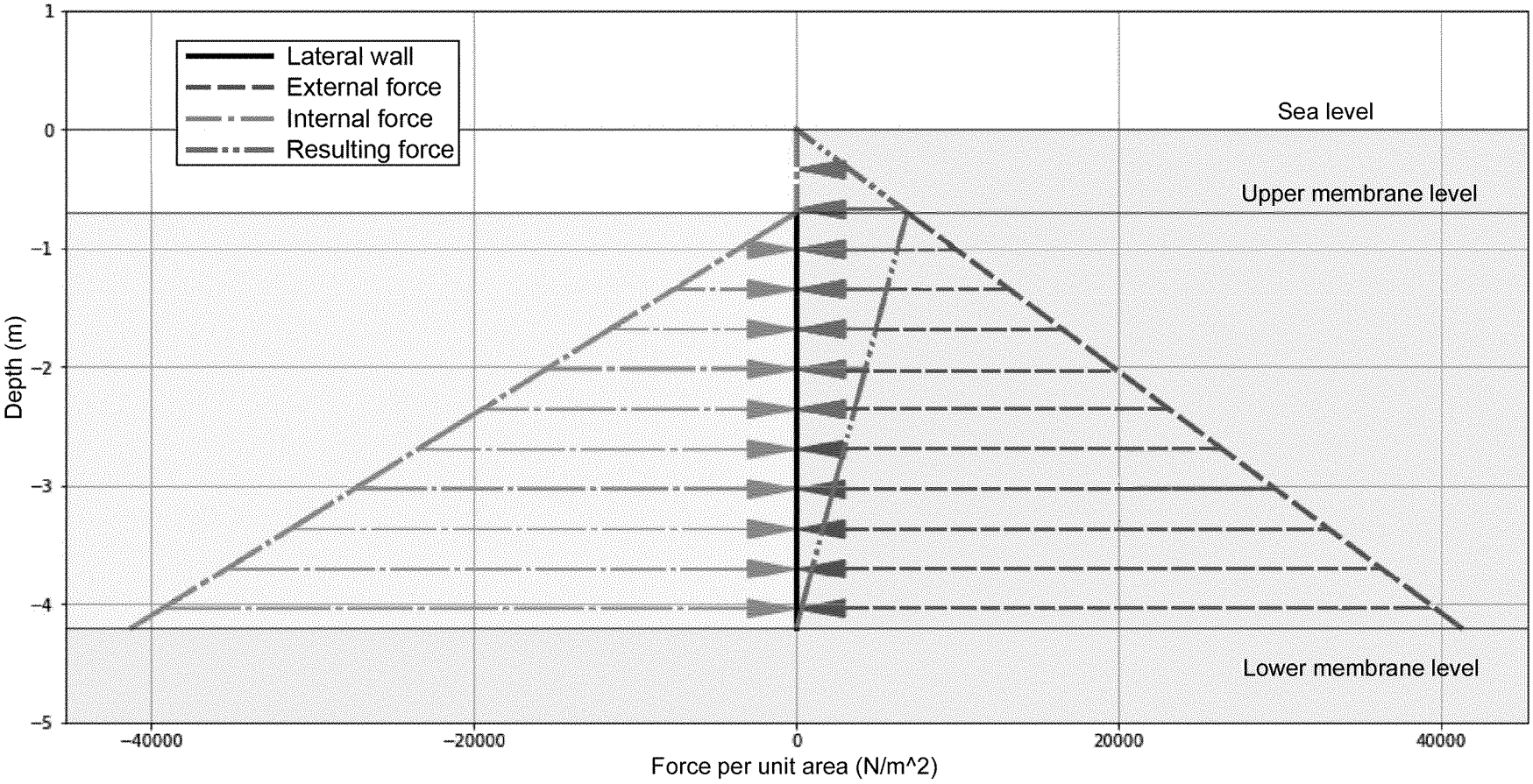
Figure 4:
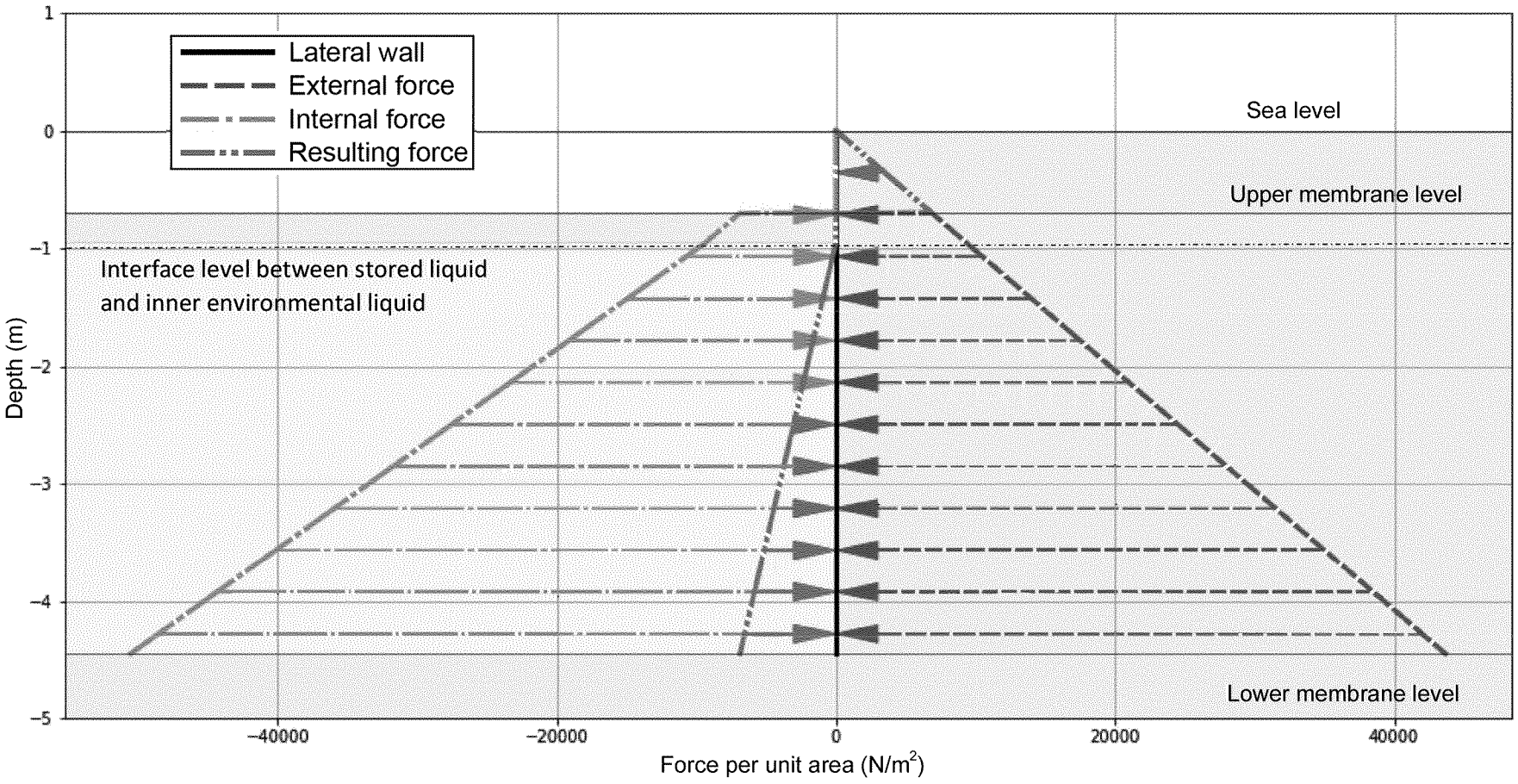
Figure 5:
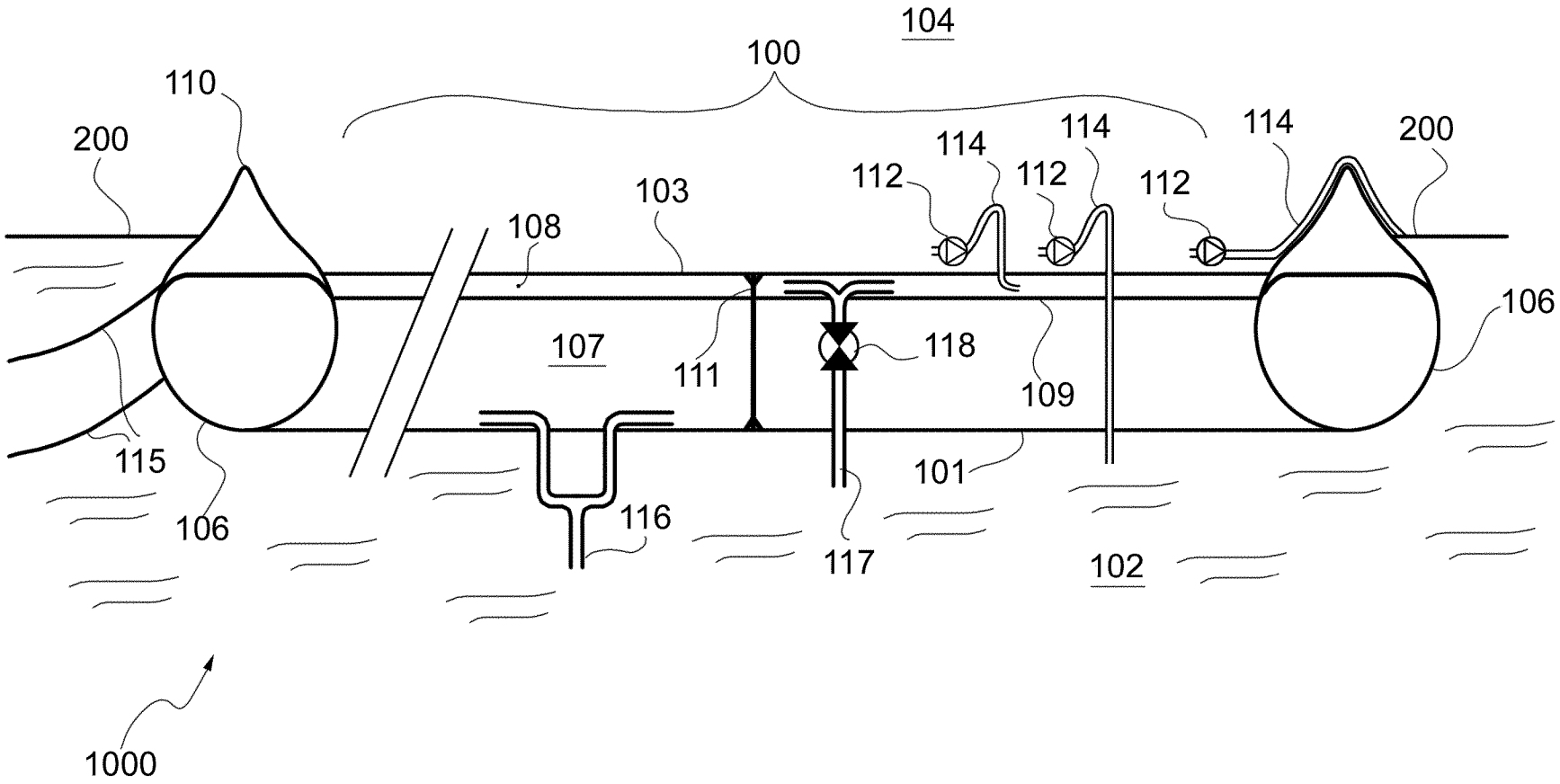
Figure 6:
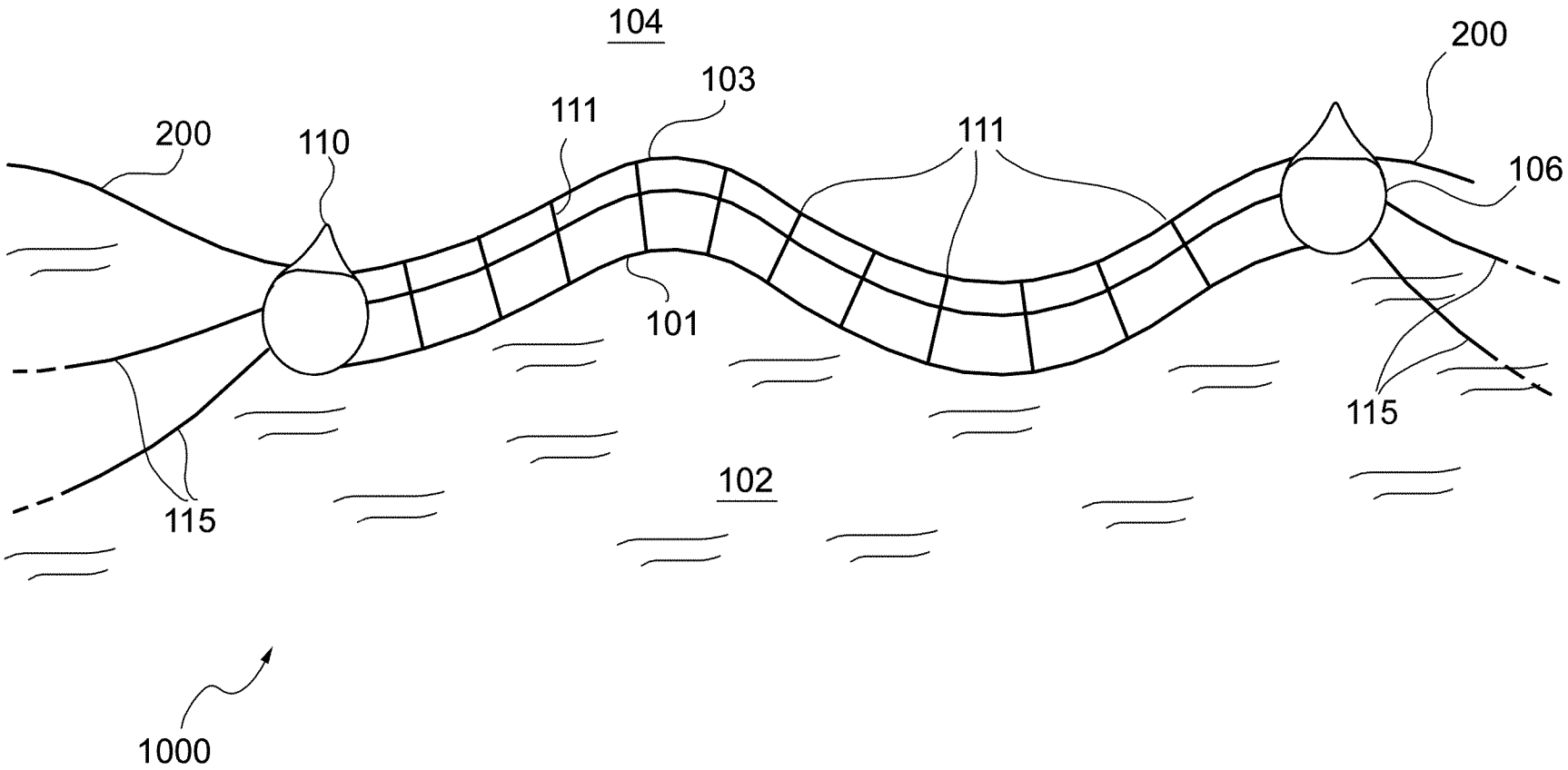
Figure 7:
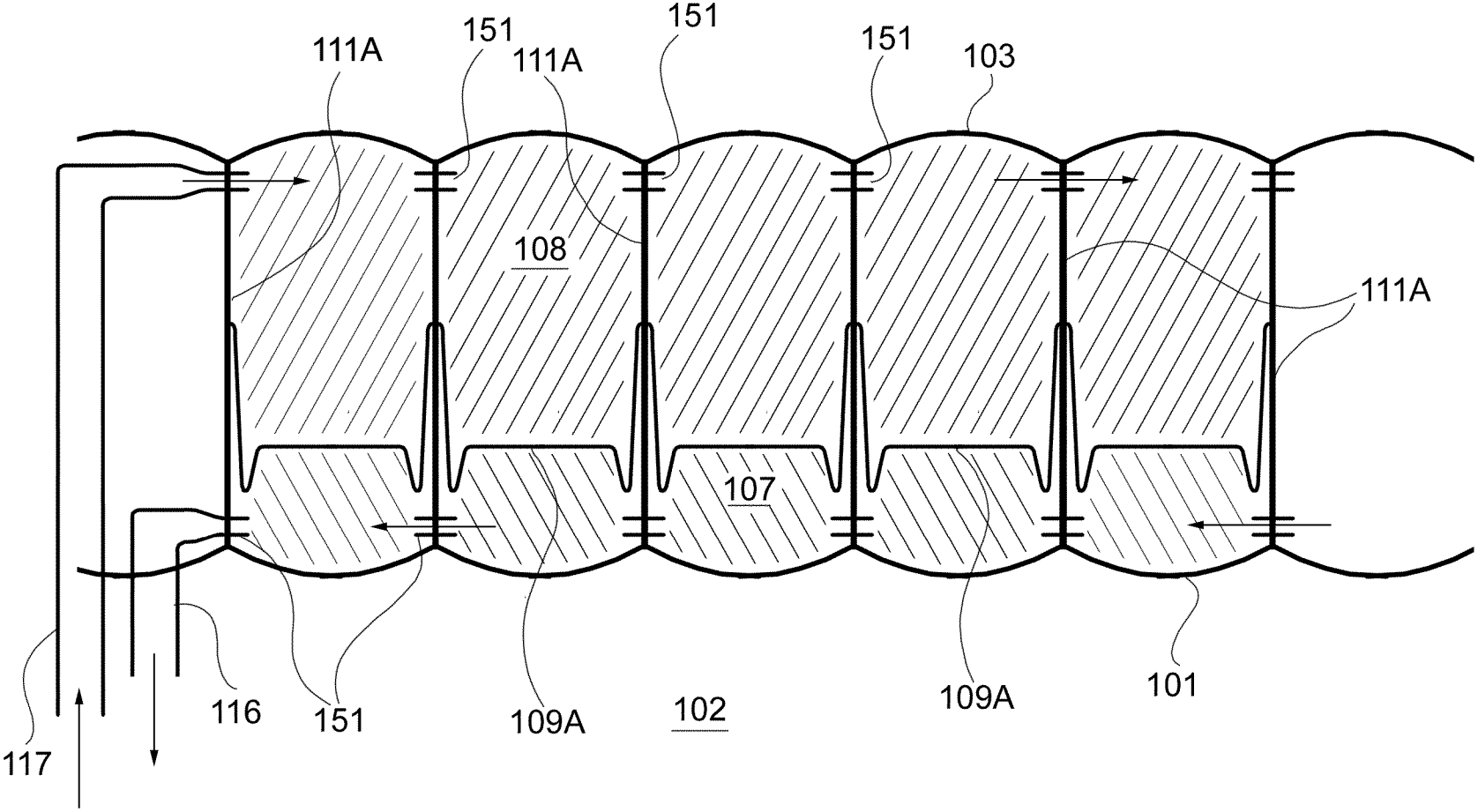
Figure 8:
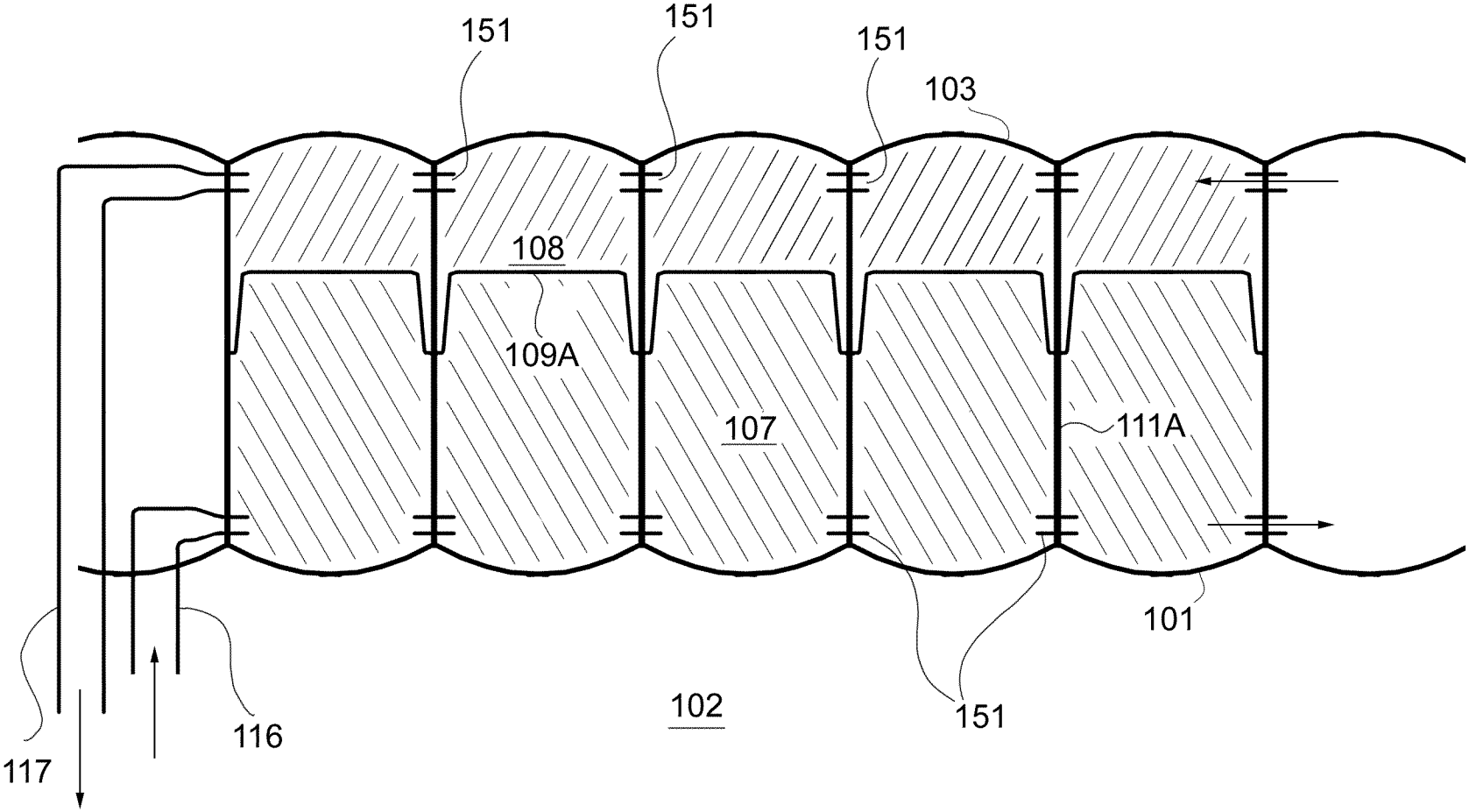
Figure 9:
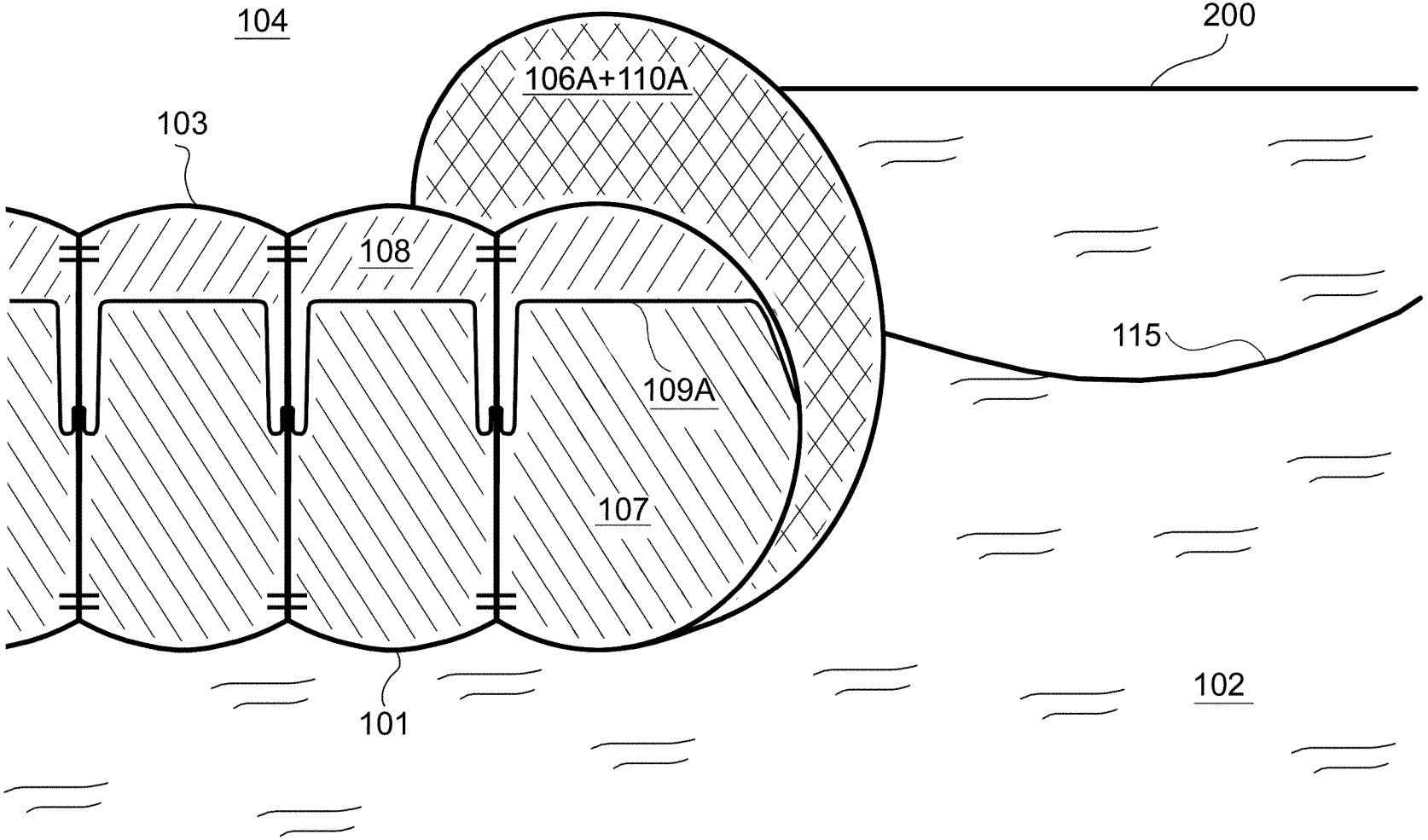
Figure 10:
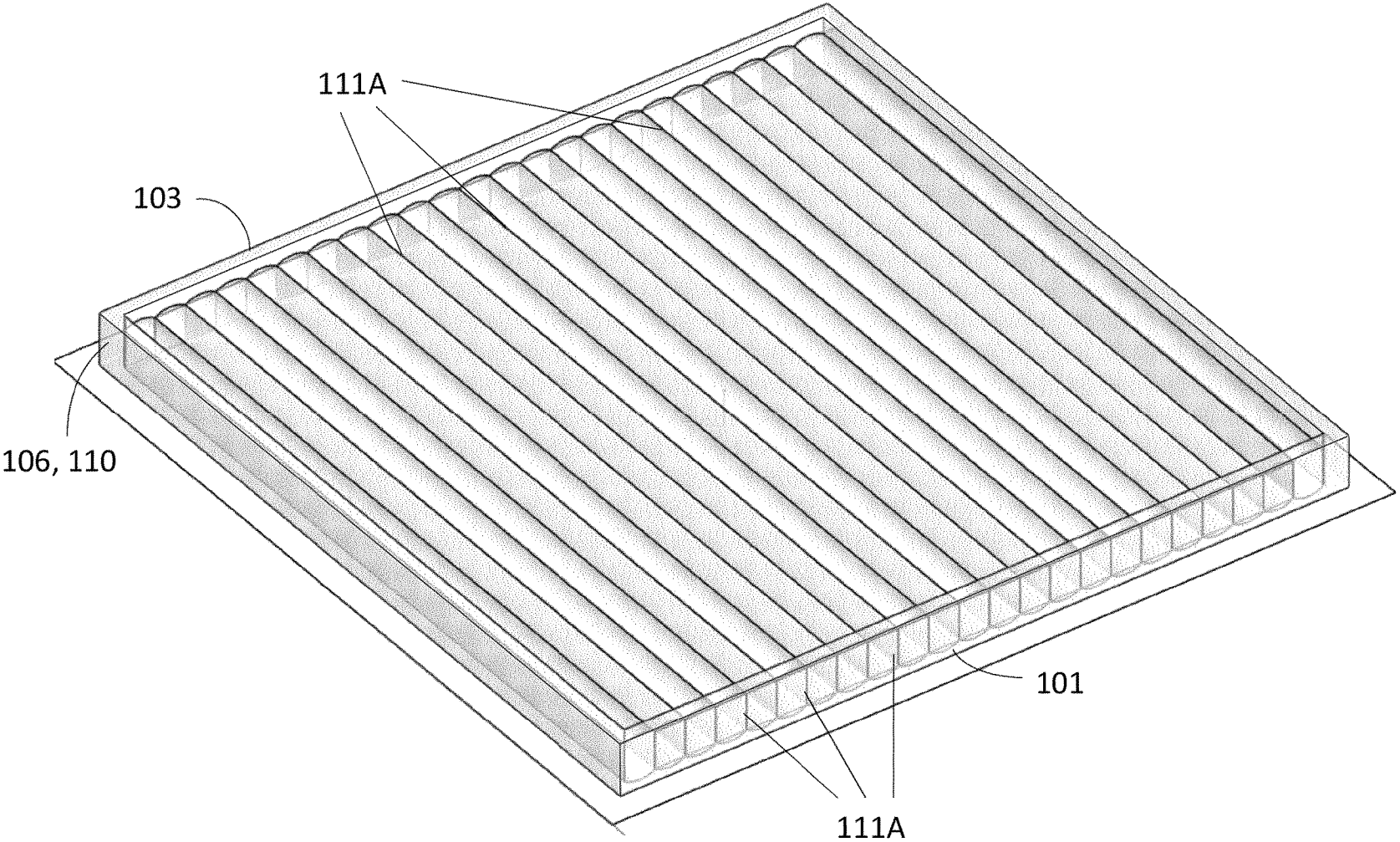
Figure 11:
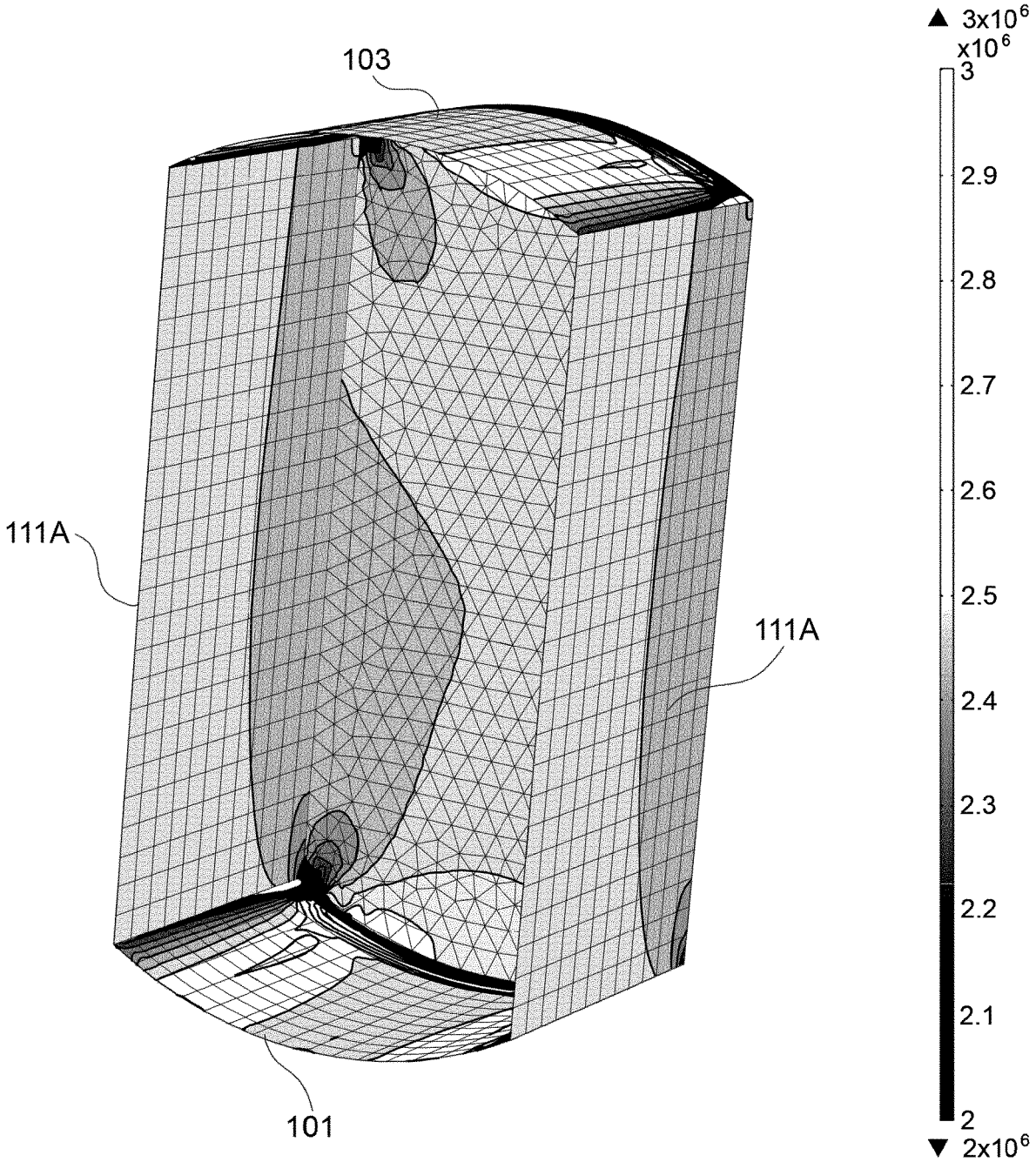
Figure 12:
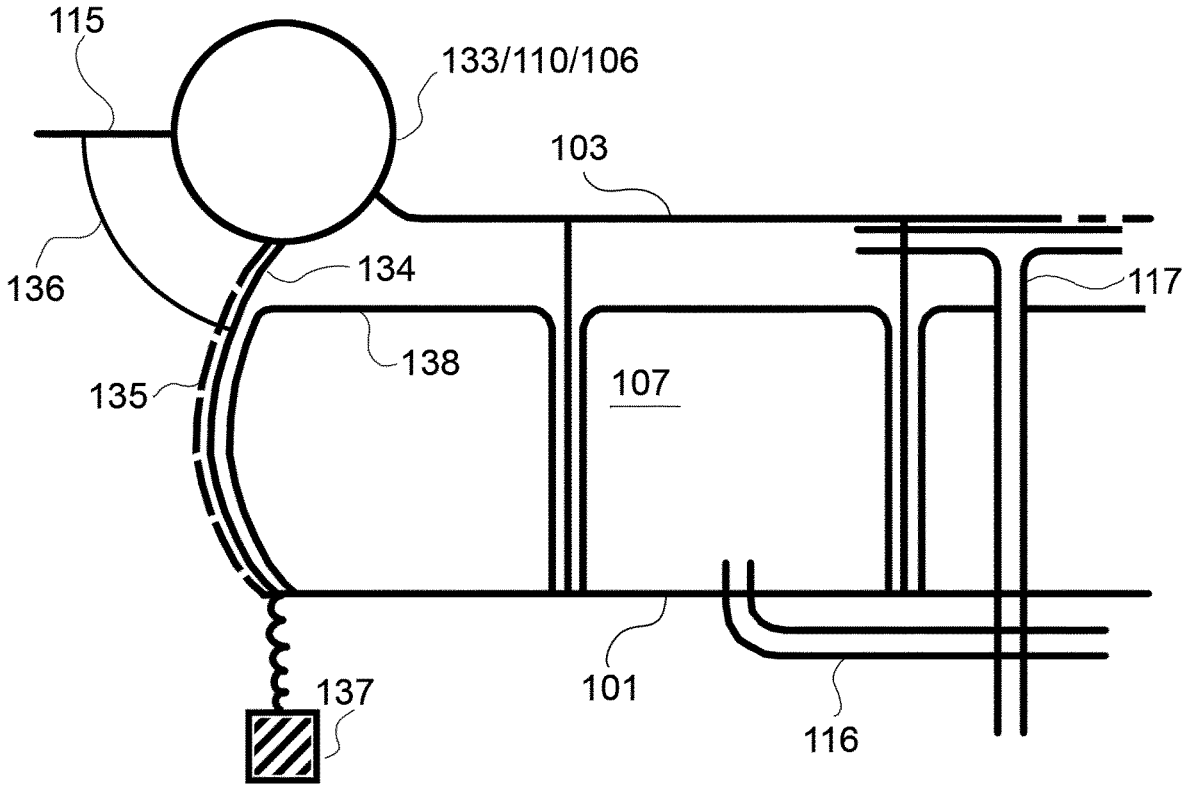
Figure 13:
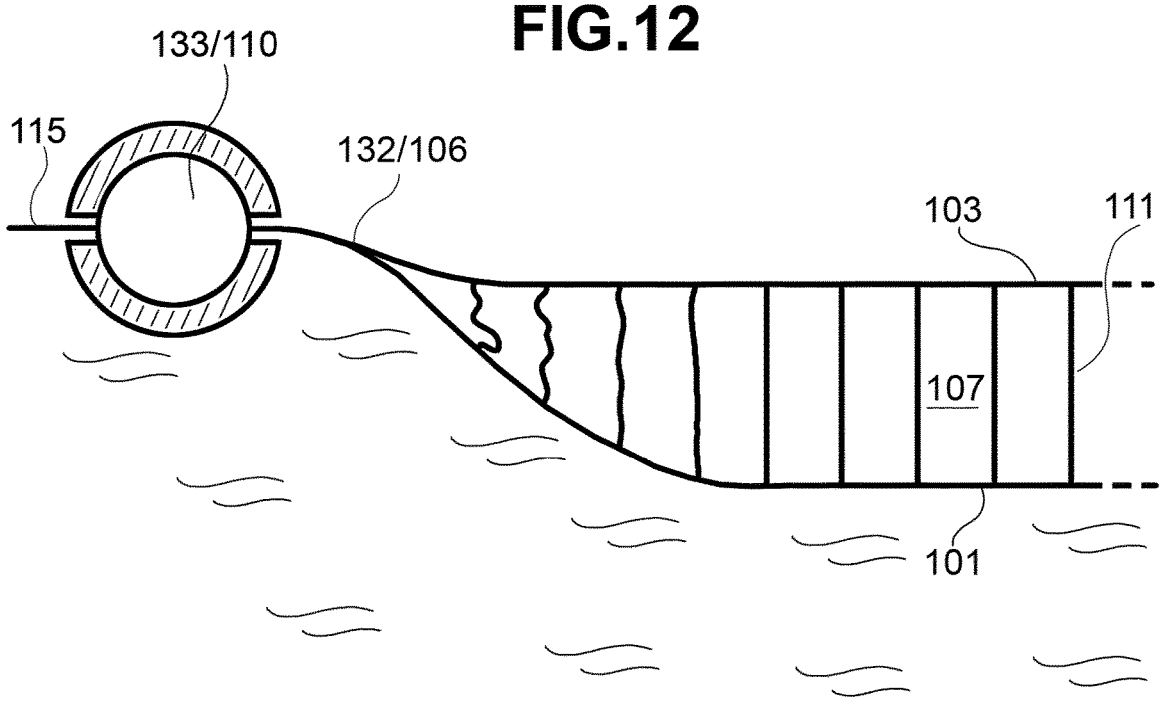
Figure 14:
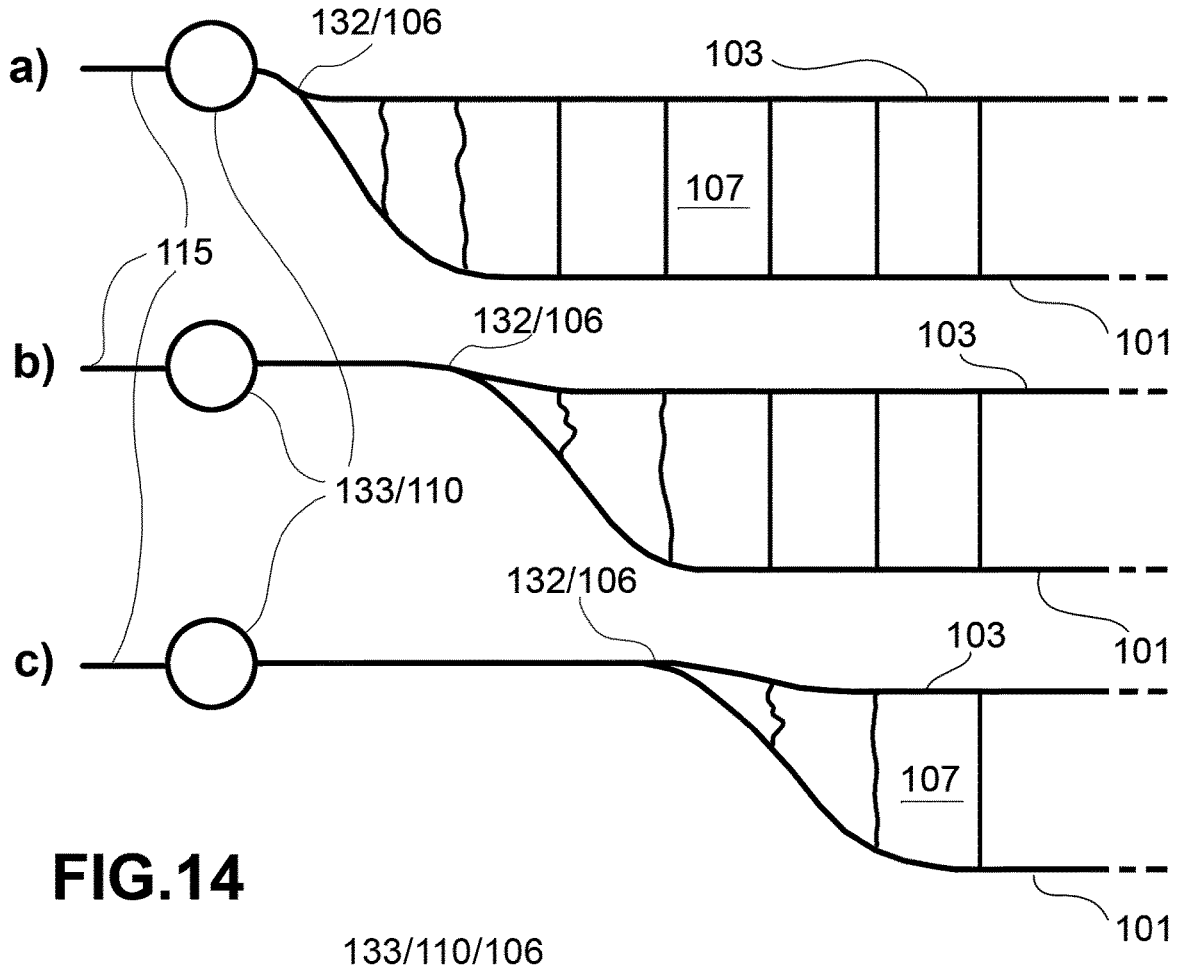
Figure 15:
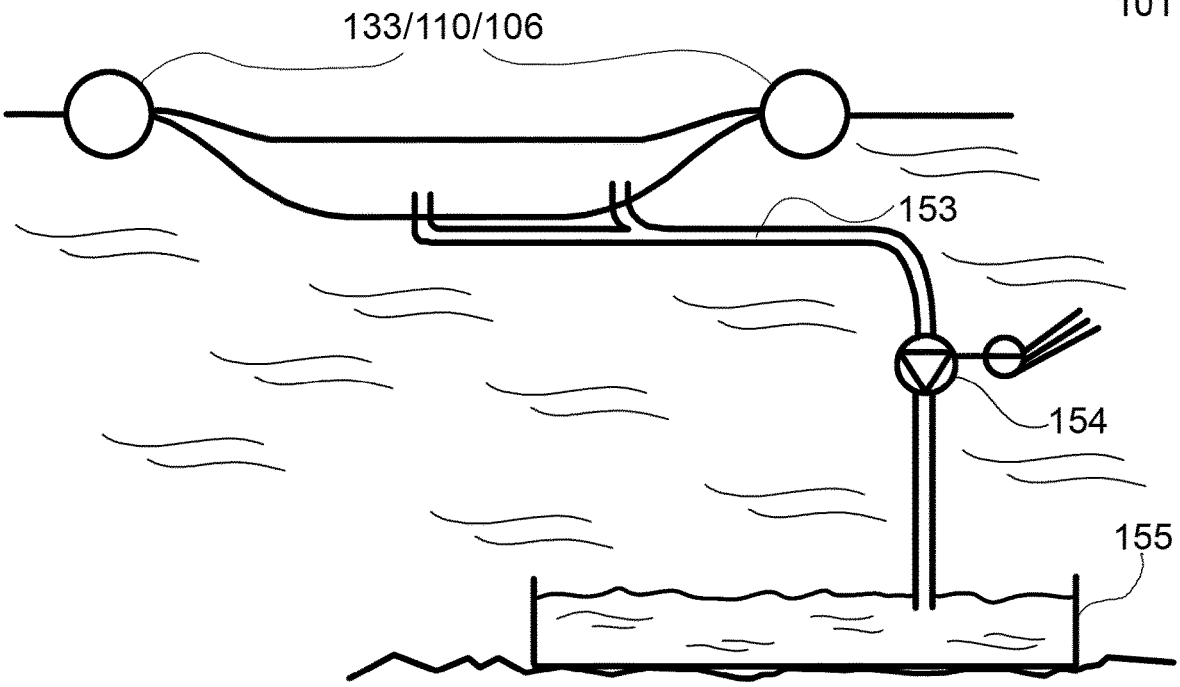
Figure 16:
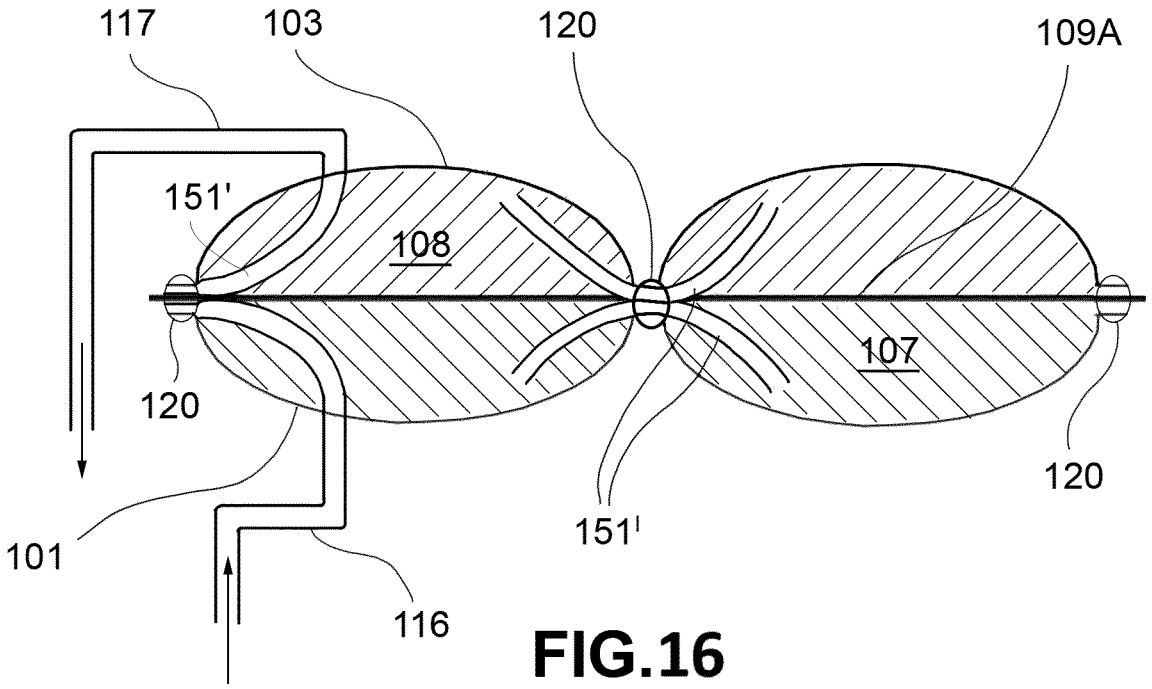
Figure 17:
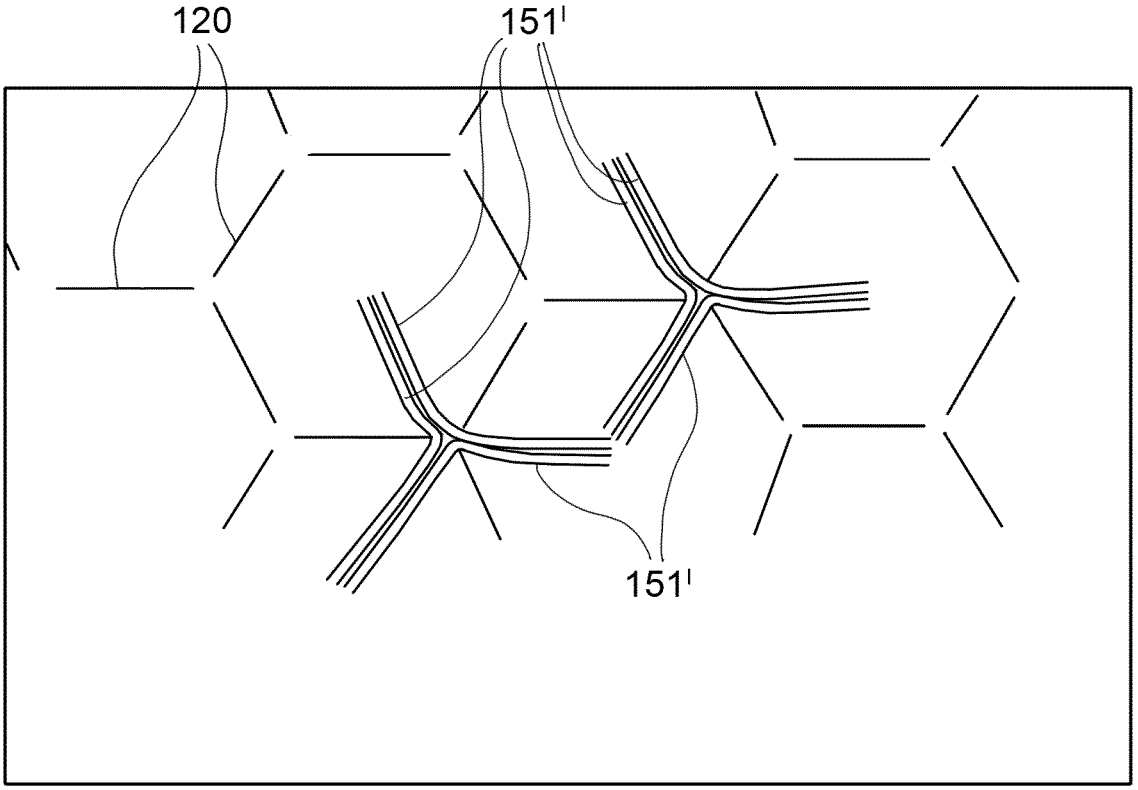

FIG. 3 schematically shows the balance of forces along a perimeter barrier means of the reservoir in case the pressurization mechanism disclosed in the present invention is not employed;

FIG. 4 schematically shows the balance of forces along the barrier means of the reservoir in case, according to the present invention, the reservoir is sufficiently pressurized to counter the hydrostatic pressure of the environmental liquid;

FIG. 5 shows common elements to different embodiments of the system according to the invention in a still position;

FIG. 6 shows the embodiment of FIG. 5 under the action of a sea wave;

FIG. 7 shows a section of the main body of a preferred embodiment of the system, using within the enclosure seawater on top of a heavier liquid and a passive system for pressure regulation;

FIG. 8 shows a variation of the main body of the embodiment of FIG. 7, in conjunction with a higher level of filling of stored liquid;

FIG. 9 shows a section of the borders of the embodiment of FIGS. 7 and 8;

FIG. 10 shows a model used for dimensioning the embodiment of FIGS. 7, 8 and 9. For simplicity, it only shows the lower pliable membrane 101, the upper pliable membrane 103, the vertical pliable membranes 111A, and exemplary means 106 and 110 in the form of a rectangular light structure;

FIG. 11 shows the results of a numerical structural mechanics calculation used for dimensioning the embodiment of FIGS. 7, 8 and 9, wherein black continuous lines separate areas with different values of Von Mises stresses;

FIG. 12 shows another preferred embodiment of the system, wherein the enclosure is partially filled with seawater on top of the heavier liquid and the system uses a passive system for pressure regulation;

FIG. 13 shows a further embodiment of the system, with an enclosure containing only the stored liquid and tensioned by a mooring system;

FIG. 14 shows different states of the system of FIG. 13 in different states having levels of filling decreasing from (a) to (c); and FIG. 15 shows an exemplary connection of the invention system to an energy conversion system;

FIG. 16 shows, in a cross-section view, a further embodiment of the invention system, with vertical connection between upper and lower membranes obtained by means of weldings along pre-determined segments (intermediate pliable membranes can be welded together with the upper and lower ones); and FIG. 17 shows, in a top view, a still further embodiment of the invention system, wherein the weldings of FIG. 16 are made along segments disposed in a honeycomb pattern.

GENERAL CONCEPTS OF THE INVENTION

The present invention addresses at least one of the following problems: guaranteeing floatation, vertical stability, and lateral stability to a flexible reservoir including an enclosure that contains a stored liquid that is heavier than the environmental liquid in which the reservoir is immersed.

In the present invention, the stored liquid (e.g., sea salt brine, molasses) is vertically contained in one enclosure between two pliable membranes. With "membrane" it is here intended any material layer that is sufficiently impermeable to seawater and the stored liquid.

The two pliable membranes are substantially horizontal when the environmental liquid is at rest, besides some local bending (wherein "local" is e.g. the same order of magnitude as the distance between the upper and lower membranes) that can be used to limit stresses on the membranes.

The two pliable membranes can be designed to experience limited bending stresses by adapting to the waves, or at least by adapting to waves with wavelengths equal or longer than a main dimension of the membranes. More precisely, the lower and upper pliable membranes can be configured to bend in order to adapt to waves and swells in the environmental liquid having a wavelength longer than the maximum vertical distance between the membranes, preferably at least by 10 times.

The pliable membranes can be made of one or multiple layers of fabrics or different materials, flexible sheets, or a composite structure of rigid and flexible materials, as well as cables, ropes, chains or other tensioned structures that may be necessary to reinforce the membranes.

The two pliable membranes are constituted by a lower membrane that is lower along the gravity force direction, and an upper membrane, that is placed above the lower membrane with respect to the gravity direction. In other words, the lower membrane is destined to be more submersed into the sea than the upper membrane. In use, when the membranes follow the sea waves by bending, we can speak of a the vertical direction as defined from the lower pliable membrane to the upper pliable membrane, and of a horizontal plane defined as plane perpendicular to said vertical direction, the vertical direction and horizontal plane substantially coinciding, in use and with the environmental fluid at rest, with a direction inverse to gravity force and the plane of the environmental liquid surface (which is in contact with environmental air), respectively.

It is here to be specified that, in this description, what is defined by the devices in use with the (external) environmental liquid at rest, continues to apply when the devices are operated in the normal motion of the environmental liquid. However, defining quantities out of the state of rest is unnecessarily more complex.

The lower pliable membrane separates the environmental liquid (e.g., seawater) from the stored liquid and possibly other elements and liquids that may be contained in the reservoir.

The upper pliable membrane separates the stored liquid and possibly other elements and liquids that may be contained in the reservoir from the free atmospheric air. The upper pliable membrane is not only used to contain the stored liquid, but it is used as an essential element of means to stabilize the reservoir, as explained below.

In order to favor bending of the reservoir, it is preferable that said lower and upper pliable membranes be relatively close to each other with respect to the maximum horizontal dimension of the reservoir. For instance, the average distance between said lower and upper pliable membranes can be less than 20% of the maximum horizontal dimension of the reservoir, preferably less than 10%. In fact, the closer the membranes, the lower the difference in their curvatures due to waves. A reduced curvature difference between the upper and lower pliable membranes is expected to lessen mechanical constraints due to sea waves on other elements of the reservoir such as the perimeter connection means and the tensioning elements described below.

Perimeter connection means are employed between respective perimeters of said at least one lower and one upper pliable membranes to separate laterally the one enclosure and the environmental liquid. For example, one could connect the two pliable membranes (cf. FIGS. 13-14, see explanation below), or optionally employ additional devices and structures to this end (cf. FIGS. 9 and 12, see explanation below).

Said upper and lower pliable membranes, and said perimeter connection means, create an enclosure where the stored liquid is stored.

With "pliable" membrane, a membrane material that is at least partially flexible is to be understood, which is able to bend at least so that it can assume the curvature of waves with relatively long wavelengths (for instance, wavelengths several times longer than the maximum vertical distance between the lower and upper pliable membranes) without undergoing plastic deformations and without generating significant stresses.

As an element of means of pressure regulation of the reservoir, as explained below, the possibility exists to allow ingress of the environmental liquid at the inside top of said enclosure, so that said enclosure contains both the stored liquid (in the lower part) and the environmental liquid (in the upper part) as two contiguous layers along said vertical direction (optionally separated by an additional separation membrane or equivalent means). The stored liquid being below the environmental liquid in said enclosure can be important for said pressure regulation, as explained below.

Means to Guarantee the Floatation of the Reservoir

A standard engineering way that could be used to guarantee the floatation of a flexible enclosure containing a liquid that is heavier than the surrounding environmental liquid is to employ floatation elements like buoys. However, as mentioned above, this solution results in the use of a large number of expensive floatation elements, as well as in expensive structures to transfer tension from the floatation elements to the reservoir.

The present invention avoids the use of floatation elements, i.e. the reservoir can float without flotation elements external or internal to the enclosure, such as buoys. The basic concept for flotation is to exploit a volume of free atmospheric air (environmental air) comprised between the upper pliable membrane and the undisturbed free surface level of the environmental liquid to reach hydrostatic equilibrium. To this purpose, the upper pliable membrane lies below the free surface of the environmental liquid thanks to barrier means that are employed to prevent the lateral ingress of the environmental liquid above the upper pliable membrane. More precisely, a volume of environmental air is defined within the barrier means, the at least one upper pliable membrane and a surface parallel to and spaced apart from the at least one upper pliable membrane at a distance substantially equal to the depth of said at least one upper pliable membrane into the external environmental liquid along said vertical direction.

Moreover, suitable liquid flowing means (e.g., pumps and pipes) can be used to evacuate the environmental liquid that may flow on top of said separation means, as well as the liquid that might accumulate from rain and precipitation. In general, the liquid flow means are configured to regulate an ingress and/or egress of the external environmental liquid and/or other liquids above the at least one upper pliable membranes.

Thanks to this configuration, in static conditions, said barrier means allow the two pliable membranes to naturally reach a depth that guarantees the hydrostatic equilibrium of the reservoir. This equilibrium is reached when the mass of environmental liquid displaced by the reservoir equals the sum of the masses of the stored liquid, of the other components and liquids in the reservoir, and of the mass of free atmospheric air as defined by the upper pliable membrane, the free surface of the environmental liquid and said barrier means.

As mentioned, the description above is referring to the case of the (external) environmental liquid at rest. For the sake of completeness, it is here reported a description of said hydrostatic equilibrium when the environmental liquid presents some waves. In such a case, the hydrostatic equilibrium is reached when the sum of the masses of stored liquid, other components and liquids in the reservoir, and free atmospheric air, which are contained in a floatation volume, equal the mass of environmental liquid that would occupy said flotation volume. The floatation volume is defined as the volume defined by the lower pliable membrane, said barrier means and perimeter connection means, and a surface whose points are equidistant from each isobaric surface of the environmental liquid and that overlaps with the free surface of the environmental liquid outside the reservoir.

Thanks to the described configuration, the present invention allows to achieve a hydrostatic equilibrium for a flexible reservoir of heavier liquid in a body of lighter environmental liquid without the need of floating elements internal or external to the reservoir.

Means to Guarantee the Vertical Stability of the Reservoir

Figure 1:
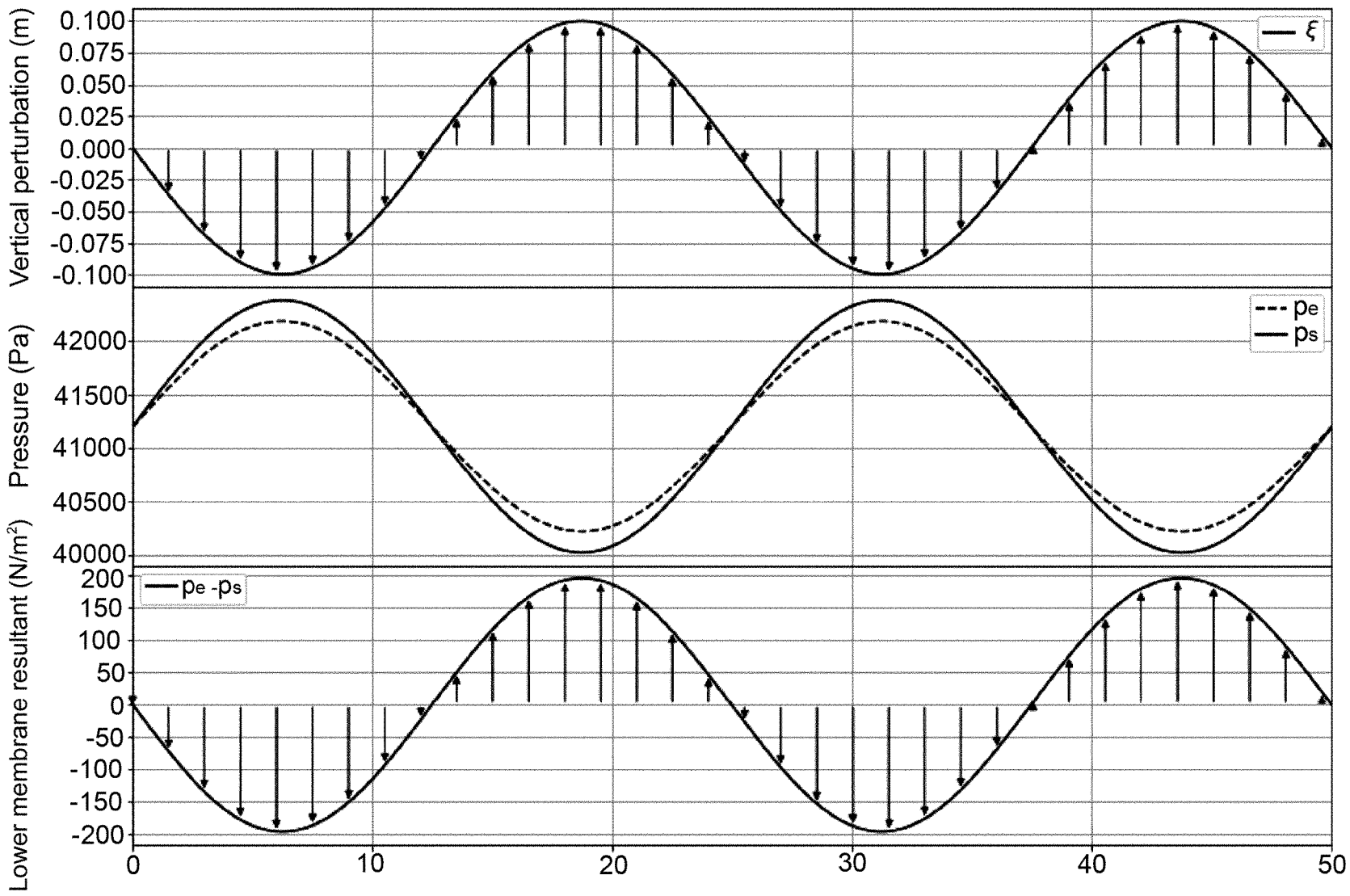
FIG. 1 shows the result of a vertical perturbation $\xi$ of a pliable membrane of the invention (more generally, an interface) separating a heavier upper liquid and a lighter lower liquid in terms of pressures $p_s$ and $p_e$ of the stored and environmental liquid, respectively, in case the stabilizing means disclosed in the present inventions are not employed.

Although the above described configuration allows to achieve a hydrostatic equilibrium, said hydrostatic equilibrium is unstable, due to the fact that a heavier liquid is placed on top of a lighter liquid: without additional means, a small perturbation that would induce a local vertical displacement of the lower pliable membrane would be amplified, possibly till loss of integrity of the reservoir. In simple terms, the basic mechanism for this instability (so-called Rayleigh-Taylor instability) is that a local vertical displacement of the lower pliable membrane generates, across the lower pliable membrane, a variation of the hydrostatic pressures of the stored liquid (inside) and of the environmental liquid (outside) that would tend to further amplify said local vertical displacement. For example, a local downward displacement of the membrane will cause the hydrostatic pressure $p_s$ of the stored liquid at the level of the membrane to increase more than the hydrostatic pressure $p_e$ of the environmental liquid at the level of the membrane, thus generating a net force pointing downwards that would amplify the displacement. An example of this phenomenon is reported in FIG. 1 for the case of a sinusoidal perturbation of the lower pliable membrane. A density of the environmental liquid $\rho_e$ of 1000 kg/m$^3$ and a density of the stored liquid $\rho_s$ of 1200 kg/m$^3$ are adopted in the calculations, considering a level of the stored liquid in the reservoir of 3.5 m. Relative pressures (or Gauge pressures) are employed, i.e., pressures are expressed with reference to the atmospheric pressure at the level of the undisturbed free surface of the environmental liquid.

As a first stabilization means to vertically stabilize the system against downward-pointing local displacements, the present invention employs tensioning means which can include one or more tensioning elements such as cables, chains, membranes or other tensioned structures to connect the upper and lower pliable membranes. As a consequence, a local downward displacement of the lower pliable membrane will cause a similar downward displacement in the upper pliable membrane. In this way, the net downward-pointing force that originates on the lower pliable membrane due to a perturbation will be more than compensated by the upward-pointing force that originates at the upper pliable membrane and that is transferred to the lower pliable membranes by said tensioning elements. Similar to the lower pliable membrane, said upward-pointing force originates at the upper pliable membrane from the fact that the hydrostatic pressure of the air at the level of the membrane increases much less than the hydrostatic pressure of the stored or environmental liquid contained in the reservoir at the level of the membrane.

The sufficient tension of the tensioning means can be for example set up by enclosure pressurization means, so that upper and lower pliable membranes (in general the walls of the enclosure) have an outward-pointing force. By "sufficient" it is to be understood that the tensioning means, in use, substantially transfer movements along the vertical direction between the lower and the upper pliable membranes, in order to vertically stabilize the enclosure.

The enclosure pressurization means can be for example means for regulating the length of said tensioning elements, as well as pumps and/or fluidic connections with the environmental liquid. Such a regulation can be done each time the filling level of the enclosure is varied.

In other words, the present invention may employ a pressurization of the stored liquid, i.e., an absolute pressure of the stored liquid (or inner environmental liquid when an inner environmental liquid layer is placed above the stored liquid and is contained by the upper pliable membrane) at the level of the upper pliable membrane that is higher than the atmospheric pressure, and an absolute pressure of the stored liquid at the level of the lower pliable membrane that is higher than that of the environmental liquid immediately below.

Said pressurization will create a tension on said tensioning means/elements, which is necessary to guarantee the stabilizing function of said tensioning means/elements against upward-pointing local displacements of the lower pliable membrane. This is why the enclosure pressurization means can be considered as a second stabilization means.

According to an aspect of the invention, and referring to FIGS. 16 and 17, one can have a plurality of tensioning means constituted by a plurality of weldings 120 joining the at least one lower 101 with the at least one upper 103 pliable membranes, along pre-determined corresponding segments of the at least one lower 101 and the at least one upper 103 pliable membranes (intermediate pliable membrane 109A can also be welded together with upper and lower membranes).

The plurality of tensioning means 111, 120 can be configured to substantially transfer, in use, movements along the vertical direction between the lower and the upper pliable membranes, possibly in conjunction with operation of the enclosure pressurization means. It is clear that any other suitable tensioning means of the enclosure is equally included in the invention provided that it is configured to allow or enable transmission of vertical displacements between the two membranes. The tensioning means in the form of weldings are advantageous because they eliminate the need for the vertical membranes, with important savings in terms of manufacturing costs.

Therefore, when an upward-pointing perturbation is applied to the lower pliable membrane, the tension on said tensioning means/elements will reduce, resulting in a downward-pointing restoring force on the lower pliable membrane. Said restoring force depends on the hydrostatic pressure gradient in the vicinity of the upper pliable membrane. For an upward displacement of amplitude the restoring force per unit area on the lower pliable membrane, without considering the beneficial tension of the membrane itself, will then be approximately equal to $\rho_e g\xi$ and $(2\rho_e-\rho_s)g\xi$ for a reservoir containing only stored liquid and for a reservoir also containing the environmental liquid in its upper part, respectively, wherein $\rho_s$ is the density of the stored liquid, $\rho_e$ is the density of the environmental liquid, g is the gravitational acceleration. From the above formulas, it can be seen that a reservoir also containing the environmental liquid in its upper part can only be stabilized if the stored liquid has a density equal or less than twice the density of the environmental liquid.

Rigid tensioning elements could in principle be used instead of pressure and pliable tensioning elements to transfer both downward and upward forces from the lower pliable membrane to the upper pliable membrane. However, this results in oversizing of the tensioning elements to avoid buckling and in a generally more complex (and expensive) configuration. For example, according to a model developed by the Inventors, a HDPE tensioning element would need to be orders of magnitude larger, in order to bear suitable compressive loads.

Figure 2:
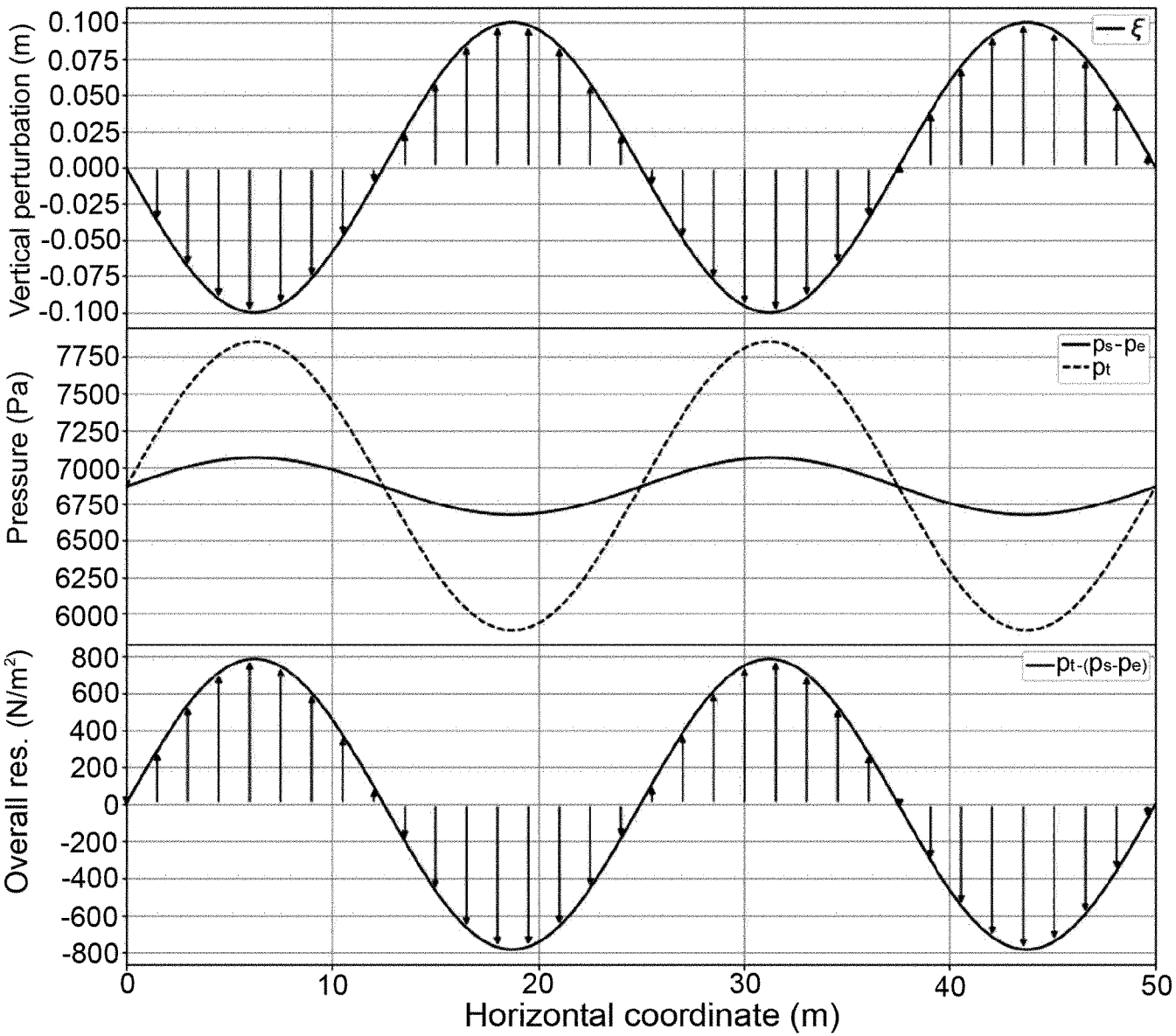
FIG. 2 shows the result of a vertical perturbation $\xi$ of the pliable membrane of FIG. 1 in terms of pressures $p_s$ and $p_e$ of the stored and environmental liquid, respectively, and the total restoring force in case the stabilizing means of the present invention are employed.

FIG. 2 shows the resulting net forces on the lower pliable membrane when said first and second stabilization means are employed, showing that a restoring force is established both for downward-pointing and upward-pointing displacements of the lower pliable membrane. A density of the environmental liquid $\rho_e$ of 1000 kg/m$^3$ and a density of the stored liquid $\rho_s$ of 1200 kg/m$^3$ are adopted in the calculations, considering a level of the stored liquid in the reservoir of 3.5 m, and a level of 0.25 m of environmental liquid internal to the reservoir, floating above the stored liquid. Relative pressures are expressed, i.e., pressures are expressed with reference to the atmospheric pressure at the level of the undisturbed free surface of the environmental liquid. The level of internal pressurization of the reservoir in the example calculation is approximately 7 kPa, therefore resulting in a pressure $p_t$ at the upper pliable membrane of 7 kPa above the atmospheric pressure.

Said first and second stabilization means would in principle require a continuous connection between the upper and lower pliable membranes. In practice, one can normally use discrete tensioning means such as elements (e.g. ropes or vertical pliable membranes) or weldings with a certain (horizontal) spacing between them. Said tensioning elements will then guarantee the vertical stability at a macroscopic scale, but not in-between them.

Hence, a third stabilization means to stabilize the lower pliable membrane in-between said tensioning elements or means consists in a maximum distance between said tensioning elements or means so that the design tension in the lower pliable membrane is sufficient to dampen the instabilities from a sinusoidal perturbation with a half wavelength equal to or smaller than said maximum distance. A simple engineering expression to approximately determine said maximum distance $D_{max}$ along a given horizontal direction in the horizontal plane can be derived from the theory of Rayleigh-Taylor instabilities and is given by the following equation:

$$D_{max} = \frac{2\pi}{\sqrt{\frac{(\rho_s - \rho_e)g}{t}}}$$

wherein $\rho_s$ is the density of the stored liquid, $\rho_e$ is the density of the environmental liquid, g is the gravitational acceleration, t is the horizontal tension (in N/m) of the lower pliable membrane along that given horizontal direction. Clearly, more accurate solutions can be obtained numerically by also including factors like local pre-existing curvatures, pressure differentials, non-uniform spacing of the tensioning elements or means as well as non-linear effects. Therefore, by "Rayleigh-Taylor instability theory" is to be understood the linear Rayleigh-Taylor theory optionally complemented by non-linear terms. However, the simple expression above provides a substantial dimensioning of said maximum distance. According to an aspect of the invention, the maximum reciprocal distance generally depends at least on $\rho_s$, $\rho_e$, the gravitational acceleration, and the horizontal tension of the at least one lower pliable membrane.

While cables, chains and tensioned structures are per se normally used to maintain the shape of an inflatable or soft structure (as in US 2004/0144294 A1), a stabilizing function is added in the present invention to the tensioning elements. Such stabilizing function is achieved in connection with the configuration described above, i.e., that of a reservoir containing a heavier liquid than the environmental liquid, featuring substantially horizontal upper and lower pliable membranes at rest, floating thanks to barrier means that allow creating a volume of air above the reservoir and below the free surface of the environmental liquid, and including pressurization means to tension said tensioning elements. In addition, said stabilizing function is obtained only when the maximum distance between said tensioning elements is lower than a value determined by the theory of Rayleigh-Taylor instabilities, for instance according to the exemplary formula for $D_{max}$ mentioned above.

Means to Guarantee the Lateral Stability of the Reservoir

A reservoir according to the current invention is subject to a lateral inward-pointing force that originates from the imbalance between the hydrostatic pressures of the external environmental liquid and internal liquids. As shown in FIG. 3, when the stored liquid is heavier than the environmental liquid, the hydrostatic pressure of the external environmental liquid is only partly countered by the hydrostatic pressure of the stored liquid. As a result, the net force would point inwards and the reservoir would collapse.

Several (lateral stabilization) means can be used to keep the reservoir open and thus to avoid its lateral collapse. One may use for instance a mooring system, where the tension is horizontalized using support buoys. Another alternative is to surround the reservoir with a rigid structure. Said rigid structure can be stabilized against buckling using chains or cables, in a similar way one uses spokes in the wheel of a bike. However, the use of a mooring system and/or that of a rigid external structure, although representing an acceptable option, adds significant costs to the system.

A preferred option for the current invention is to balance said lateral inward-pointing force by using pressurization means that allow to reach a suitable level of internal pressure, i.e., an internal pressure at the level of the upper pliable membrane that is sufficiently higher than the atmospheric pressure.

For a given density $\rho_s$ of the stored liquid, density $\rho_e$ of the environmental liquid, gravitational acceleration g, and distance H between said upper pliable membrane and said lower pliable membrane, said suitable level of relative internal pressure $P_{stab,lat}$, measured at the level of the upper pliable membrane, can be calculated approximately as:

$$P_{stab,lat} = \frac{H \cdot g}{2} \frac{\rho_s}{\rho_e} (\rho_s - \rho_e)$$

The $P_{stab,lat}$ calculated above refers to the conservative case of a reservoir entirely filled with stored liquid, substantially without internal environmental liquid. A lower stabilizing pressure can in principle be used if the reservoir also contains environmental liquid in its upper part, and if a minimum amount of said internal environmental liquid is always kept in the reservoir.

Given the fact that $P_{stab,lat}$ may not be sufficient to guarantee the tension of the tensioning means/elements above, the actual pressure $P_{int}$ inside the enclosure, which is sufficient to guarantee both horizontal and vertical stability in an embodiment has to meet the following inequality:

$$P_{int} \gtrsim P_{stab,lat}$$

Wherein the approximation in the limiting case of equality is due to the fact that the materials of the enclosure can have a certain structural tension that allows tolerance in the pressure value. Other means for guaranteeing vertical tensioning may be provided as explained.

The pressurization means configured to provide the above internal pressure can be different from the pressurization means for tensioning the above described tensioning means/elements.

An example of the forces at the borders of the reservoir in case of a pressurized reservoir is shown in FIG. 4. In the case of FIG. 4, a suitable level of pressure is achieved by having a layer of environmental liquid in the upper portion of the enclosure, with the same hydrostatic pressure as the external environmental liquid at the same elevation. This result can be obtained, as in the preferred embodiment described below, by fluidically connecting internal and external environmental liquids. A density of the environmental liquid $\rho_e$ of 1000 kg/m$^3$ and a density of the stored liquid $\rho_s$ of 1200 kg/m$^3$ are adopted in the calculations, considering a level of the stored liquid in the reservoir of 3.5 m, and a level of 0.25 m of environmental liquid internal to the reservoir, floating above the stored liquid. Relative pressures are employed, i.e., pressures are expressed with reference to the atmospheric pressure at the level of the undisturbed free surface of the environmental liquid. The level of internal pressurization of the reservoir is approximately 7 kPa.

EXEMPLARY EMBODIMENTS

Preferred embodiments of the invention will be described here for illustrative but not limitative purposes with reference to marine applications, having seawater as environmental liquid.

It is here specified that elements of different embodiments can be combined together to provide further unlimited embodiments respecting the technical concept of the invention, as the skilled person directly and unambiguously understands or infers from what has been described.

The present description also refers to the prior art for its implementation, with respect to non-described detailed features, such as for example elements of minor importance usually used in the prior art in solutions of the same type.

When we introduce an element, we always mean that it can be "at least one" or "one or more".

When listing a list of elements or characteristics in this description, it is meant that the invention "includes" or alternatively "is composed of" such elements.

When speaking of "the preferred embodiment", it is to be understood that several features can be optional within the same embodiment, as noted each time.

General Features

In order to aid in the description of the preferred and other embodiments, some features, common to some embodiments of the invention, are first summarized in FIGS. 5 and 6. Referring to FIG. 5, the main body or the enclosure 100 of the reservoir comprises two pliable membranes. A lower pliable membrane 101 isolates the reservoir from the external seawater 102. An upper pliable membrane 103 isolates the reservoir from the free atmospheric air 104. The upper and lower pliable membranes 103 and 101 are substantially horizontal when the sea is at rest, aside from local bending that can be used to reduce stresses on the membranes. The pliable membranes 101 and 103 can be made of one or multiple layers of fabrics or different materials, flexible sheets, or a composite structure of rigid and flexible materials, as well as cables, ropes, chains or other tensioned structures that may be necessary to reinforce the membranes. Suitable perimeter connection means 106 are employed to connect the pliable membranes 101 and 103 at their perimeter, in order to isolate laterally the reservoir from the external seawater 102. Said perimeter connection means 106 and the two pliable membranes 101 and 103 create an enclosure that contains the stored liquid 107 and, in some configurations and conditions, the internal seawater 108. According to an aspect of the invention, means 109 (e.g. an intermediate pliable membrane) are provided to separate the internal seawater 108 (also termed "inner upper layer") and the stored liquid 107 (also termed "inner lower layer"). The internal seawater 108, when present, is always placed on top of the store liquid 107 along the vertical direction defined above. Additional barrier means 110 are employed to prevent or limit the ingress of the external seawater 102 above the upper pliable membrane, from the sides of the reservoir, in order to create a space filled of atmospheric air 104 on top of the upper pliable membrane 103, but below the level of the free surface 200 of the external seawater and within the barrier means 110. A plurality of openings or pipes or valves for allowing to fill said at least one enclosure with said stored liquid and/or seawater may be provided (not shown).

In static conditions and in use, the barrier means 110 are configured two withstand the hydrostatic pressure of the environmental liquid 102 and to allow the pliable membranes 101 and 103 to reach a depth that guarantees the hydrostatic equilibrium of the reservoir. As explained above, said hydrostatic equilibrium is subject to instabilities that arise due to the fact that a heavier liquid is placed on top of a lighter liquid. In order to stabilize the system, tensioning elements 111 (only one is depicted for reasons of clarity of the drawing) can be employed to connect the upper and lower pliable membranes 101 and 103. Depending on the specific embodiment, the tensioning elements 111 can be one or a plurality of cables or chains or membranes or other tensioned structures. Alternative tensioning means (such as the above mentioned weldings) can be used. Moreover, pumps 112 and pipes 114 are used to evacuate the seawater that may flow on top of the upper pliable membrane and the water that might accumulate from rain and precipitation.

A mooring system 115 can be used to keep the reservoir in place, as well as to tension it in some embodiments. Said mooring system can be built on purpose for the reservoir, or benefit from other mooring systems already in place, such as that of floating wind turbines, offshore platforms, or other offshore structures.

A plurality of openings or pipes 116 can be employed to connect the stored liquid 107 with other systems external to the reservoir. A plurality of fluid connection means 117, such as openings and pipes, can be employed in some embodiments to connect the internal seawater 108 with the external seawater 102. The enclosure pressurization means may comprise the liquid connection means 117 between the inner upper layer 108 and the external environmental liquid 102, and may be configured such that, at a given elevation along said vertical direction, the hydrostatic pressure of the inner upper layer 108 substantially equals the hydrostatic pressure of the external environmental liquid 102.

A plurality of flow regulation means 118, such as pumps, valves and/or flow restrictions can be employed in some embodiments to regulate the pressure inside the reservoir.

More in general, the enclosure pressurization means can act to allow tensioning means 111 (but also 120 as described below) to substantially transfer, in use, movements along the vertical direction between the lower and the upper pliable membranes in conjunction with operation of the enclosure pressurization means.

Referring to FIG. 6, the pliable membranes 101 and 103, the means 106 and 110 and the other structures of the reservoir are designed in order to adapt to waves with a relatively long wavelengths (for instance, wavelengths several times longer than the maximum distance between the pliable membranes 101 and 103), without generating significant bending stresses.

In the present invention, the reservoir will be subjected, in use, to a net lateral force resulting from the opposite effects of the hydrostatic pressure of the seawater and the hydrostatic pressure of the stored liquid and of the atmospheric air. As a result, net resultant forces at the perimeter of the reservoir will point inwards. These forces can be balanced in several ways. One can use the lateral mooring systems 115 that pull laterally the reservoir. Alternatively, similar to the wheels of a bike, one can use a rigid structure external to the reservoir, which may correspond to the means 106 or 110, subject to compressive loads and stabilized against buckling by means of tensioned components. Finally, as for the preferred embodiment described below, one can use a suitable level of pressurization of the reservoir.

In configurations where the pressure of the stored liquid is locally higher than the pressure of the seawater at the level of the lower pliable membrane, means can be employed to prevent major losses of stored liquid in case of leaks. To this purpose, it is possible to segment the reservoir into multiple volumes separated by membranes or other structures, possibly reinforced using chains, ropes or cables. In addition, the pliable membranes could be complemented with a layer of porous, nonwoven mat that could limit leakages in case of minor ruptures.

The possibility exists to lower the reservoir below sea level to protect it from adverse weather and sea conditions. To this purpose, it is possible to empty the reservoir from the stored liquid 107 and allow access of the seawater above the upper pliable membrane 103, for instance using a valve and/or pumps (not shown in FIG. 5). In this configuration, the reservoir would have the buoyancy only determined by its structural materials. In case the reservoir would still float in these conditions, it is possible to slightly fill the reservoir and/or its structures with some of the stored liquid or of the seawater. Once the reservoir presents negative buoyancy, the desired depth can be set by connecting the reservoir to buoys at the surface using cables, ropes or chains of suitable length.

Preferred Embodiment of the Invention

Referring to FIGS. 7, 8 and 9, the preferred embodiment of the invention uses a passive system of pressure regulation that solves the problems of both lateral and vertical stability of the reservoir, for all possible levels of filling of stored liquid 107, and for stored liquids 107 whose density is at maximum two times that of the external seawater (in particular, the stored liquid can have a density $\rho_s$ such that $\rho_e<\rho_s<2\rho_e$, wherein $\rho_e$ is the density of the environmental liquid). By "passive" we mean without the need of active elements such as pumps.

The preferred embodiment contains both the stored liquid 107 and the internal seawater 108, floating or stratified above the stored liquid. No or very limited tension is transmitted to the pliable membranes 101 and 103 by the mooring system 115, which is used to maintain the position of the reservoir. The pliable membranes 101 and 103 are vertically connected using one or more connecting pliable membranes 111A representing the above means 111. The one or more connecting pliable membranes 111A can be placed vertically or diagonally. Optional additional pliable membranes 109A are employed to separate the stored liquid 107 and the internal seawater 108, which are otherwise kept separated by density-based stratification (the membrane 109A is represented as spaced apart from membrane 111A only for reasons of clarity). Optional pipes or openings 151 are employed to fluidically connect the stored liquid 107 through the membranes 111A, and/or to fluidically connect the internal seawater 108 through the membranes 111A. The pipes or openings 151 are optionally employed to make sure that the stored liquid 107 can be extracted from any position in the reservoir, and that the internal seawater 108 is fluidically connected to the external seawater 102 in any position in the reservoir. In-between the connection points of the pliable membranes 101 and 111A, and in-between the connection points of the pliable membranes 103 and 111A, the pliable membranes 101 and 103 may be arched in order to limit the stresses due to the differential pressure across them. A plurality of pipes or openings, corresponding to the fluid connection means 117, connect the internal seawater 108 with the external seawater 102.

This embodiment allows to passively regulate the pressure of the reservoir for any level of filling of the stored liquid 107 so that the reservoir can achieve lateral stability substantially without tension from the mooring system 115 and without relying on the force exerted by rigid structures.

In the limiting case where the reservoir is substantially full of stored liquid 107: seawater only fills a relatively thin layer at the top of the reservoir; the upper pliable membrane 103 is below the free surface of the external seawater 102 in order to respect the hydrostatic balance; for a given density $\rho_s$ of the stored liquid, density $\rho_e$ of the environmental liquid, gravitational acceleration g, and distance H between the lower upper pliable membrane 101 and the upper pliable membrane 103, the relative internal pressure $P_0$ at the level of the upper pliable membrane 103 becomes equal to:

$$P_0=H\cdot g(\rho_s-\rho_e)$$

From the above formula, it can be seen that the preferred embodiment guarantees a pressure $P_0$ higher than $P_{stab,lat}$, if the stored liquid has a density equal or less than twice the density of the environmental liquid.

In the other limiting case where the reservoir is substantially empty of stored liquid 107: seawater substantially fills the whole reservoir; the upper pliable membrane 103 substantially reaches the level of the free surface of the external seawater 102 in order to respect the hydrostatic balance; the internal pressure at the level of the upper pliable membrane 103 becomes near-atmospheric. As a result, the hydrostatic pressures inside and outside of the reservoir are essentially the same, thus not requiring substantial tension from the mooring system or the use of rigid structures to keep the system open.

The non-negative outward-pointing force that is necessary at the borders of the reservoir to stabilize laterally the reservoir is then maximum when the reservoir is substantially full of stored liquid 107, and slightly higher than zero when the reservoir is substantially empty of stored liquid 107. An intermediate situation is obtained for partial fillings of the reservoir. In all cases, no substantial tension from the mooring system, nor rigid structures, are necessary to keep the system open.

The passive pressurization provided by this preferred embodiment is also sufficient to solve the problem of the vertical stability of the reservoir against Rayleigh-Taylor instabilities. The internal pressure of the reservoir will remain equal to or higher than the external pressure of the seawater for perturbations of the lower pliable membrane 101 as wide as the distance between the lower pliable membrane 101 and the upper pliable membrane 103.

For the plurality of fluid connection means 117 to be effective in their pressure regulation function, they must be designed so that the pressure drops through them are small enough during charge and discharge of the reservoir, to ensure that the reservoir pressurization does not fall below the required stabilizing pressure during discharge and does not rise above the maximum bearable reservoir design pressure. This could be achieved for instance by employing large enough diameters for the pipes. On the other hand, it is useful to the reservoir response to waves, swells and other external perturbations to employ flow regulation means 118 (not shown in FIGS. 7, 8, 9) such as a pipe restriction or a sufficiently small diameter for the pipes, in order to prevent significant flow in case of high frequency perturbations.

With reference to FIG. 9, in the preferred embodiment, both means 106 and 110 are represented by a light structure 106A+110A, for instance made of polyurethane foam and surrounded by (e.g. composite) pliable membranes. The pliable membranes 111A and 109A are similar to the pliable membranes 101 and 103, but with different thicknesses depending on their working stresses. All membranes can be weldable and welding can be used to connect them.

Alternative Configuration of the Preferred Embodiment

In the case where the tensioning means are constituted by or include the weldings 120 above, the liquid communication between the thus created compartments may be realized by means of pipes 151' passing through said weldings between the upper and/or lower pliable membranes 101,103, as in FIGS. 16 and 17. The plurality of openings or pipes 116 above can be employed in this embodiment to connect the stored liquid 107 with other systems external to the reservoir. The same holds for the plurality of fluid connection means 117, such as openings and pipes, to connect the internal seawater 108 with the external seawater 102.

Example of Mechanical Dimensioning of the Preferred Embodiment of the Invention

With reference to FIG. 10, a practical example of the preferred embodiment is filled with sea salt brine with a density 20% higher than seawater. The distance between the upper pliable membrane 103 and the lower pliable membrane 101 is set to 3.75 m, with the filling level of salt brine equal to 3.5 m. Vertical, straight, parallel pliable membranes 111A are employed as means 111.

According to this configuration, the hydrostatic equilibrium sets the level of the upper pliable membrane 103 at 0.7 m below the level of the undisturbed free surface of the seawater 102. The passive pressure regulation sets the pressurization to approximately 7 kPa above the atmospheric pressure.

The upper pliable membrane 103 and the lower pliable membrane 101 are locally bent to limit stresses on the membranes. Stresses on the membranes can be calculated using numerical calculations, as shown in FIG. 11. According to these calculations, Von-Mises stresses (on the grey scale on the right) can be limited to an acceptable value of 3 MPa by locally arching the upper pliable membrane 103 and the lower pliable membrane 101, by employing a 4 mm thick HDPE membrane for both the upper pliable membrane 103 and the lower pliable membrane 101, and by distancing the vertical pliable membranes 1.75 m from each other.

As mentioned above, the passive pressure regulation determines an outward pointing force at the lateral perimeter of the reservoir. This force determines a horizontal tension (on the horizontal plane as defined above) in the upper pliable membrane 103 and in the lower pliable membrane 101, depending on the filling of the reservoir. The minimum value of said horizontal tension can be used to evaluate, for various fillings of the reservoir, the maximum distance $D_{max}$ between the vertical pliable membranes 111A that allows for a vertical stabilization of the reservoir. $D_{max}$ can be estimated as $$D_{max} = \frac{2\pi}{\sqrt{\frac{(\rho_s - \rho_e)g}{t}}}$$

wherein $\rho_s$ is the density of the stored liquid, $\rho_e$ is the density of the environmental liquid, g is the gravitational acceleration, t is the horizontal tension (in N/m) of the lower pliable membrane between, and perpendicular to, the vertical pliable membranes 111A.

Other Embodiments

Another embodiment of the current invention is similar to the preferred embodiment, except that the pressurization of the reservoir is actively regulated using valves or pumps 118.

Referring to FIG. 12, another embodiment of the current invention uses the same passive pressure regulation as the preferred embodiment. However, the means 106 and 110 are represented by a pliable membrane 134 and by a tubular structure 133 which functions also as barrier means 110. The pliable membrane 134 can be similar to the pliable membranes 101 and 103 and can be reinforced by a net of chains or cables 135. The position of the pliable membrane 134 can be maintained via a plurality of connections 136 to the mooring system 115 and/or by using a set of weights 137. A plurality of bags or bladders 138 contain the stored liquid 107 (the membrane 138 is represented as spaced apart from membrane 134 only for reasons of clarity). Alternatively to the bags or bladders 138, one may use an additional substantially horizontal pliable membrane placed in between the pliable membranes 101 and 103 as in FIG. 5. A plurality of pipes or openings 116 connect the plurality of bags or bladders 138 with external systems (such as an energy conversion system). A plurality of pipes 117 and flow regulation means 118 may connect the internal seawater 108 with the external seawater 102.

Referring to FIGS. 13 and 14, another embodiment of the reservoir contains only the stored liquid 107 and no internal seawater 108. Referring to FIG. 13, the pliable membranes 101 and 103 are substantially horizontal and parallel to the undisturbed free surface when floating on cairn seawater, beside a local arching that can be used to limit stresses. However, at the border of the reservoir, they are raised to the free surface of the external seawater 102, touching each other along a line 132 (substantially a point in the side-view of FIGS. 13 and 14). Such a line represents the perimeter means 106. A tubular structure 133 represents in this configuration the means 110. Referring to FIG. 14, when the reservoir is only partially filled, the perimeter contact surface between the two pliable membranes 101 and 103 will tend to increase, and the line 132 to move radially towards the center of the reservoir (the filling decreases from (a) to (c) with equal tension of the mooring system 115). In the embodiment of FIGS. 13 and 14, the horizontal inward-pointing force generated by the balance of hydrostatic pressures at the perimeter of the reservoir can be compensated by the mooring system and/or by the tubular structure 133. The tubular structure 133 can be connected to the reservoir around the perimeter connection means 106 in such a way to transmit a tension. It can have a certain rigidity to provide a tensioning function and can be reinforced against buckling using horizontal tensioned elements, similar to the spokes in the wheel of a bike (not shown in FIGS. 13 and 14). Any cross section of the tubes of the tubular structure is here to be understood as functional. As an alternative, or in addition, it is possible to sufficiently pressurize the system by regulating the length of the tensioning elements 111 (with or without other active pressurization). In the embodiment of FIGS. 13 and 14, the shape of the reservoir and the pressure of the stored liquid 107 may depend on the horizontal tension transmitted by the mooring system 115 or by the tubular structure 133. A stronger tension tends to reduce the pressure in the reservoir. Such an embodiment allows to go beyond the condition of $\rho_e<\rho_s<2\rho_e$ for the preferred embodiment above, enabling the more general condition of $\rho_e<\rho_s$, thanks to the possibility of mechanical tensioning and/or the fact that there is no liquid communication between the internal and external environmental liquid (due to the absence of internal environmental liquid).

Method of Operation of the Reservoir

According to an aspect of the invention, the operation of the invention reservoir is realized by execution of the following steps:

A. Providing a reservoir as defined in one embodiment above;

B. Immersing the reservoir into the external environmental liquid;

C. Filling the at least one enclosure 100 at least partially with the stored liquid 107 and optionally with internal environmental liquid 108;

D. Regulating the internal pressure of the at least one enclosure by the passive pressurization means of an embodiment above or pressurization means for obtaining vertical stability and the means for avoiding horizontal (lateral) collapse as above explained.

Steps C and D are preferably concurrent.

The flotation of the reservoir can be regulated by executing one or more of the following sub-steps:

1. Fully or partly emptying the enclosure from the liquid and/or the internal environmental liquid;
2. Allowing access of the environmental liquid above the at least one upper composite pliable membrane;
3. Connecting the reservoir to buoys using chains and ropes in order to regulate its depth when the reservoir is not buoyant nor floating.

Example of Usage of the Preferred and Other Embodiments

With reference to FIG. 15, the invention is connected via one or more pipes 153 to an energy conversion system 154. Said energy conversion system 154 is connected to an underwater reservoir 155 at a lower elevation than the above-described reservoir. The invention, the one or more vertical pipes 153, the energy conversion system 154 and the underwater reservoir 155 are operated as an energy storage system by the following steps:

Letting the stored liquid flow from the upper reservoir to the lower reservoir;

Deriving work from the flow generated in the previous step;

Converting such work into electric energy; and

Transferring said electric energy to shore or offshore electric loads.

In particular, the reservoir disclosed in the present invention can be used to store gravitational energy in a floating pumped-hydro energy storage system. In said energy storage system, gravitational energy is stored in the reservoir by pumping the stored liquid from a point at a lower elevation. Said gravitational energy can then be converted into work by letting the stored liquid flow to said point of lower elevation.

In the foregoing, the preferred embodiments have been described and variants of the present invention have been suggested, but it is to be understood that those skilled in the art will be able to make modifications and changes without thereby departing from the corresponding scope of protection, as defined by the attached claims.

What is claimed is:

1. A flexible floating reservoir for storing and/or transporting a stored liquid in an external environmental liquid, the external environmental liquid having a density $\rho_e$ and being in contact with environmental air through an external environmental liquid surface, the flexible floating reservoir being immersible in said external environmental liquid and comprising at least one enclosure configured to contain an inner upper layer of external environmental liquid on top of an inner lower layer of the stored liquid along a vertical direction, and comprising:

at least one lower pliable membrane configured to separate the inner lower layer from the external environmental liquid;

at least one upper pliable membrane configured to separate the inner upper layer from the environmental air;

wherein a vertical direction is defined from the at least one lower pliable membrane to the at least one upper pliable membrane, and a horizontal plane is defined as a plane perpendicular to said vertical direction, the vertical direction and horizontal plane substantially coinciding, in use and with the external environmental liquid at rest, with a direction inverse to the gravitational force and the external environmental liquid surface, respectively;

wherein the at least one enclosure is configured to contain the stored liquid that has a density $\rho_s$ such that $\rho_e<\rho_s<2\rho_e$, the flexible floating reservoir further comprising:

perimeter connection means between respective perimeters of said at least one lower pliable membrane and the at least one upper pliable membrane;

barrier means extending in said vertical direction and configured to keep, in use and with the external environmental liquid at rest, a volume of the environmental air comprised within the barrier means, the at least one upper pliable membrane and the horizontal plane, the barrier means being dimensioned so that the flexible floating reservoir is at hydrostatic equilibrium in the external environmental liquid at rest;

enclosure pressurization means comprising liquid connection means between the inner upper layer and the external environmental liquid which are configured such that, at a given elevation along said vertical direction, a hydrostatic pressure of the inner upper layer substantially equals a hydrostatic pressure of the external environmental liquid; and a plurality of tensioning means constituted by either:

a plurality of tensioning elements with a lower end and an upper end fixed within the at least one enclosure to the at least one lower pliable membrane and the at least one upper pliable membrane, respectively; or a plurality of weldings joining the at least one lower pliable membrane with the at least one upper pliable membrane, along pre-determined corresponding segments of the at least one lower and the at least one upper pliable membranes;

the plurality of tensioning means being configured to substantially transfer, in use, movements along the vertical direction between the at least one lower pliable membrane and the at least one upper pliable membrane in conjunction with operation of the enclosure pressurization means; and wherein the plurality of tensioning means is distributed throughout the at least one enclosure with a maximum reciprocal distance perpendicular to the vertical direction, that is, in use and with the external environmental liquid at rest, smaller than a minimum half-wavelength of a perturbation that amplifies instabilities on the lower pliable membrane as defined by Rayleigh-Taylor instability theory.

2. The flexible floating reservoir of claim 1, wherein said enclosure pressurization means include active pressure regulation means.

3. The flexible floating reservoir of claim 1, wherein at least a subset of the plurality of tensioning elements are constituted by tensioning pliable membranes subdividing the at least one enclosure into a plurality of compartments, wherein adjacent compartments are connected by at least one of through openings, pipes, valves.

4. The flexible floating reservoir of claim 1, wherein at least a subset of the plurality of tensioning means are constituted by the weldings joining the at least one lower pliable membrane with the at least one upper pliable membrane, along the pre-determined corresponding segments of the at least one lower and the at least one upper pliable membranes, thus subdividing the at least one enclosure into a plurality of compartments, wherein adjacent compartments are connected by pipes passing through said weldings between the at least one lower pliable membrane and the at least one upper pliable membrane.

5. The flexible floating reservoir of claim 1, wherein separation means are provided to separate the inner upper layer and the inner lower layer, the separation means being placed between the at least one lower pliable membrane and the at least one upper pliable membrane.

6. The flexible floating reservoir of claim 5, wherein the separation means are one or more intermediate pliable membranes.

7. The flexible floating reservoir of claim 1, wherein an average vertical distance between the at least one lower pliable membrane and the at least one upper pliable membrane is ≤20% of a maximum surface extension thereof.

8. The flexible floating reservoir of claim 1, wherein said maximum reciprocal distance depends at least on the density of the stored liquid $\rho_s$, the density of the external environmental liquid $\rho_e$, the gravitational acceleration, and a horizontal tension of the at least one lower pliable membrane.

9. The flexible floating reservoir of claim 1, further comprising liquid flow means configured to regulate an ingress and/or an egress of the external environmental liquid and/or other liquids above the at least one upper pliable membrane and the at least one lower pliable membrane.

10. The flexible floating reservoir of claim 1, wherein the flexible floating reservoir comprises a plurality of enclosures connected to each other.

11. An underwater energy storage system, comprising an upper reservoir and a lower reservoir, and a conversion system for converting gravitational energy of a working liquid flowing from said upper to said lower reservoirs, wherein the upper reservoir is the flexible floating reservoir of claim 1 and the working liquid is the stored liquid.

12. A method for producing energy, the method comprising:

providing the underwater energy storage system of claim 11;

letting the stored liquid flow from the upper reservoir to the lower reservoir;

deriving work from the flow generated in the previous step;

converting said work into electric energy; and transferring said electric energy to shore or offshore electric loads.

13. A flexible floating reservoir for storing and/or transporting a stored liquid in an external environmental liquid, the external environmental liquid having a density $\rho_e$ and being in contact with environmental air through an external environmental liquid surface, the flexible floating reservoir being immersible in said external environmental liquid and comprising at least one enclosure configured to contain at least one inner layer of the stored liquid and comprising:

at least one lower pliable membrane configured to separate the at least one inner layer from the external environmental liquid;

at least one upper pliable membrane configured to separate the at least one inner layer from the environmental air;

wherein a vertical direction is defined from the at least one lower pliable membrane to the at least one upper pliable membrane, and a horizontal plane is defined as a plane perpendicular to said vertical direction, the vertical direction and horizontal plane substantially coinciding, in use and with the external environmental liquid at rest, with a direction inverse to the gravitational force and the plane of the external environmental liquid surface, respectively;

wherein the at least one enclosure is configured to contain the stored liquid that has a density $\rho_s$ such that $\rho_e < \rho_s$, the flexible floating reservoir further comprising:

perimeter connection means between respective perimeters of said at least one lower pliable membrane and the at least one upper pliable membrane;

barrier means extending in said vertical direction and configured to keep, in use and with the external environmental liquid at rest, a volume of the environmental air comprised within the barrier means, the at least one upper pliable membrane and the horizontal plane, the barrier means being dimensioned so that the flexible floating reservoir is at hydrostatic equilibrium in the external environmental liquid at rest;

lateral stabilization means configured to substantially balance out, in use and with the external environmental liquid at rest, a hydrostatic pressure of the external environmental liquid and a hydrostatic pressure inside the at least one enclosure along any direction on a plane parallel to said horizontal plane; and a plurality of tensioning means constituted by either:

a plurality of tensioning elements with a lower end and an upper end fixed within the at least one enclosure to the at least one lower pliable membrane and the at least one upper pliable membrane, respectively; or a plurality of weldings joining the at least one lower pliable membrane with the at least one upper pliable membrane, along pre-determined corresponding segments of the at least one lower and the at least one upper pliable membranes;

the plurality of tensioning means being configured to substantially transfer, in use, movements along the vertical direction between the at least one lower pliable membrane and the at least one upper pliable membrane in conjunction with further means selected from the group comprising enclosure pressurization means, a mooring system, and a tubular structure connected to the flexible floating reservoir around the perimeter connection means; and wherein the plurality of tensioning means is distributed throughout the at least one enclosure with a maximum reciprocal distance perpendicular to the vertical direction, that is, in use and with the external environmental liquid at rest, smaller than a minimum half-wavelength of a perturbation that amplifies instabilities on the at least one lower pliable membrane as defined by Rayleigh-Taylor instability theory.

14. The flexible floating reservoir of claim 13, wherein the lateral stabilization means are the enclosure pressurization means which are configured to pressurize the at least one enclosure, in conjunction with the tensioning means, such that internal pressure $P_{int}$ of the at least one enclosure is:

$$P_{int} \gtrsim \frac{H \cdot g}{2} \frac{\rho_s}{\rho_e} (\rho_s - \rho_e)$$

wherein g is the gravitational acceleration and H an average vertical distance between the at least one lower pliable membrane and the at least one upper pliable membrane.

15. The flexible floating reservoir of claim 13, wherein the enclosure pressurization means, or the lateral stabilization means, include means for regulating a length of the plurality of tensioning elements.

16. The flexible floating reservoir of claim 13, wherein at least a subset of the plurality of tensioning elements are constituted by tensioning pliable membranes subdividing the at least one enclosure into a plurality of compartments, wherein adjacent compartments are connected by at least one of through openings, pipes, valves.

17. The flexible floating reservoir of claim 13, wherein at least a subset of the plurality of tensioning means are constituted by the weldings joining the at least one lower pliable membrane with the at least one upper pliable membrane, along the pre-determined corresponding segments of the at least one lower and the at least one upper pliable membranes, thus subdividing the at least one enclosure into a plurality of compartments, wherein adjacent compartments are connected by pipes passing through said weldings between the at least one lower pliable membrane and the at least one upper pliable membrane.

18. The flexible floating reservoir of claim 13, wherein an average vertical distance between the at least one lower pliable membrane and the at least one upper pliable membrane is ≤20% of a maximum surface extension thereof.

19. The reservoir of claim 13, wherein said maximum reciprocal distance depends at least on the density of the stored liquid $\rho_s$, the density of the external environmental liquid $\rho_e$, the gravitational acceleration, and a horizontal tension of the at least one lower pliable membrane.

20. The flexible floating reservoir of claim 13, further comprising liquid flow means configured to regulate an ingress and/or an egress of the external environmental liquid and/or other liquids above the at least one upper pliable membrane and the at least one lower pliable membrane.

21. The flexible floating reservoir of claim 13, wherein the flexible floating reservoir comprises a plurality of enclosures connected to each other.

22. An underwater energy storage system comprising an upper reservoir and a lower reservoir, and a conversion system for converting gravitational energy of a working liquid flowing from said upper to said lower reservoirs, wherein the upper reservoir is the flexible floating reservoir of claim 13 and the working liquid is the stored liquid.

23. A method for producing energy, the method comprising:

providing the underwater energy storage system of claim 22;

letting the stored liquid flow from the upper reservoir to the lower reservoir;

deriving work from the flow generated in the previous step;

converting said work into electric energy; and transferring said electric energy to shore or offshore electric loads.

24. A method for operating a flexible floating reservoir, the method comprising:

providing a flexible floating reservoir for storing and/or transporting a stored liquid in an external environmental liquid, the external environmental liquid having a density $\rho_e$ and being in contact with environmental air through an external environmental liquid surface, the flexible floating reservoir being immersible in said external environmental liquid and comprising at least one enclosure configured to contain an inner upper layer of external environmental liquid on top of an inner lower layer of the stored liquid along a vertical direction, and comprising:

at least one lower pliable membrane configured to separate the inner lower layer from the external environmental liquid;

at least one upper pliable membrane configured to separate the inner upper layer from the environmental air;

wherein a vertical direction is defined from the at least one lower pliable membrane to the at least one upper pliable membrane, and a horizontal plane is defined as a plane perpendicular to said vertical direction, the vertical direction and horizontal plane substantially coinciding, in use and with the external environmental liquid at rest, with a direction inverse to the gravitational force and the external environmental liquid surface, respectively;

wherein the at least one enclosure is configured to contain the stored liquid that has a density $\rho_s$ such that $\rho_e<\rho_s<2\rho_e$, the flexible floating reservoir further comprising:

perimeter connection means between respective perimeters of said at least one lower pliable membrane and the at least one upper pliable membrane;

barrier means extending in said vertical direction and configured to keep, in use and with the external environmental liquid at rest, a volume of the environmental air comprised within the barrier means, the at least one upper pliable membrane and the horizontal plane, the barrier means being dimensioned so that the flexible floating reservoir is at hydrostatic equilibrium in the external environmental liquid at rest;

enclosure pressurization means comprising liquid connection means between the inner upper layer and the external environmental liquid which are configured such that, at a given elevation along said vertical direction, a hydrostatic pressure of the inner upper layer substantially equals a hydrostatic pressure of the external environmental liquid; and a plurality of tensioning means constituted by either:

a plurality of tensioning elements with a lower end and an upper end fixed within the at least one enclosure to the at least one lower pliable membrane and the at least one upper pliable membrane, respectively; or a plurality of weldings joining the at least one lower pliable membrane with the at least one upper pliable membrane, along pre-determined corresponding segments of the at least one lower and the at least one upper pliable membranes; the plurality of tensioning means being configured to substantially transfer, in use, movements along the vertical direction between the at least one lower pliable membrane and the at least one upper pliable membrane in conjunction with operation of the enclosure pressurization means; and wherein the plurality of tensioning means is distributed throughout the at least one enclosure with a maximum reciprocal distance perpendicular to the vertical direction, that is, in use and with the external environmental liquid at rest, smaller than a minimum half-wavelength of a perturbation that amplifies instabilities on the lower pliable membrane as defined by Rayleigh-Taylor instability theory;

immersing the flexible floating reservoir into the external environmental liquid;

filling the at least one enclosure at least partially with the stored liquid and additionally with external environmental liquid in the inner upper layer; and regulating internal pressure $P_{int}$ of the at least one enclosure by the enclosure pressurization means.

25. The method of claim 24, wherein flotation of the flexible floating reservoir is regulated by executing one or more of the following sub-steps:

fully or partly emptying the at least one enclosure from the stored liquid and the external environmental liquid in the inner upper layer;

allowing access of the external environmental liquid above the at least one upper pliable membrane; and connecting the flexible floating reservoir to buoys using chains and ropes to regulate depth of the flexible floating reservoir when the flexible floating reservoir is neither buoyant nor floating.

26. A method for operating a flexible floating reservoir, the method comprising:

providing a flexible floating reservoir for storing and/or transporting a stored liquid in an external environmental liquid, the external environmental liquid having a density $\rho_e$ and being in contact with environmental air through an external environmental liquid surface, the flexible floating reservoir being immersible in said external environmental liquid and comprising at least one enclosure configured to contain at least one inner layer of the stored liquid and comprising:

at least one lower pliable membrane configured to separate the at least one inner layer from the external environmental liquid;

at least one upper pliable membrane configured to separate the at least one inner layer from the environmental air;

wherein a vertical direction is defined from the at least one lower pliable membrane to the at least one upper pliable membrane, and a horizontal plane is defined as a plane perpendicular to said vertical direction, the vertical direction and horizontal plane substantially coinciding, in use and with the external environmental liquid at rest, with a direction inverse to the gravitational force and the plane of the external environmental liquid surface, respectively;

wherein the at least one enclosure is configured to contain the stored liquid that has a density $\rho_s$ such that $\rho_e<\rho_s$, the flexible floating reservoir further comprising:

perimeter connection means between respective perimeters of said at least one lower pliable membrane and the at least one upper pliable membrane;

barrier means extending in said vertical direction and configured to keep, in use and with the external environmental liquid at rest, a volume of the environmental air comprised within the barrier means, the at least one upper pliable membrane and the horizontal plane, the barrier means being dimensioned so that the flexible floating reservoir is at hydrostatic equilibrium in the external environmental liquid at rest;

lateral stabilization means configured to substantially balance out, in use and with the external environmental liquid at rest, a hydrostatic pressure of the external environmental liquid and a hydrostatic pressure inside the at least one enclosure along any direction on a plane parallel to said horizontal plane; and a plurality of tensioning means constituted by either:

a plurality of tensioning elements with a lower end and an upper end fixed within the at least one enclosure to the at least one lower pliable membrane and the at least one upper pliable membrane, respectively; or a plurality of weldings joining the at least one lower pliable membrane with the at least one upper pliable membrane, along pre-determined corresponding segments of the at least one lower and the at least one upper pliable membranes;

the plurality of tensioning means being configured to substantially transfer, in use, movements along the vertical direction between the at least one lower pliable membrane and the at least one upper pliable membrane in conjunction with further means selected from the group consisting of enclosure pressurization means, a mooring system, and a tubular structure connected to the flexible floating reservoir around the perimeter connection means; and wherein the plurality of tensioning means is distributed throughout the at least one enclosure with a maximum reciprocal distance perpendicular to the vertical direction, that is, in use and with the external environmental liquid at rest, smaller than a minimum half-wavelength of a perturbation that amplifies instabilities on the at least one lower pliable membrane as defined by Rayleigh-Taylor instability theory;

immersing the flexible floating reservoir into the external environmental liquid;

filling the at least one enclosure at least partially with the stored liquid; and regulating internal pressure $P_{int}$ of the at least one enclosure by the lateral stabilization means.

27. The method of claim 26, wherein flotation of the flexible floating reservoir is regulated by executing one or more of the following sub-steps:

fully or partly emptying the at least one enclosure from the stored liquid;

allowing access of the external environmental liquid above the at least one upper pliable membrane; and connecting the flexible floating reservoir to buoys using chains and ropes to regulate depth of the flexible floating reservoir when the flexible floating reservoir is neither buoyant nor floating.

* * * * *